US006371553B1

(12) United States Patent
Tang

(10) Patent No.: US 6,371,553 B1
(45) Date of Patent: Apr. 16, 2002

(54) COLLAPSIBLE SUNSHADE FOR CASUAL SEATING

(76) Inventor: Larry Tang, 45 Park Knoll Dr., East Brunswick, NJ (US) 08816

( * ) Notice: Subject to any disclaimer, the term of this patent is extended or adjusted under 35 U.S.C. 154(b) by 0 days.

(21) Appl. No.: 09/597,665

(22) Filed: Jun. 21, 2000

(51) Int. Cl.[7] ..... A47C 7/62

(52) U.S. Cl. ..... 297/184.1; 297/184.11; 297/184.15

(58) Field of Search ..... 297/184.1, 184.15, 297/184.11

(56) References Cited

U.S. PATENT DOCUMENTS 3,404,915 A * 10/1968 De Souza Filho ..... 297/184.15
5,096,257 A * 3/1992 Clark ..... 297/184.15 X
5,203,363 A * 4/1993 Kidwell et al. ..... 297/184.15

* cited by examiner

*Primary Examiner*—Anthony D. Barfield
(74) *Attorney, Agent, or Firm*—Charles I. Brodsky

(57) ABSTRACT

A sunshade for casual seating of the type including a reclining beach chair or lounger, a patio chair and a cot, each of which is collapsible to a compact package, in which a sunshade canopy fixed with a fabric covering is secured in a manner to be collapsible along with the casual seating when the seating is closed to a compact package, and in which the canopy can be rotated open to an angle either horizontal to the ground or tilted to the ground, being then secured in position by a pin which restrains wind gusts from blowing the canopy upwardly.

10 Claims, 33 Drawing Sheets

171
171
B
163
A
A
B
162
160
163
30
33
50
28
143
144
33
142
45
16
141
18
24
117
35
126
26
25
35
126
113
115
111
37
25
10
104
37
20
60
91
95
103
91
95
25
93
102
25
14
55
103
101
12
40
101
22
77
102
40

A,B
470,472
490,492

470,472
490,492

A,B
470,472
490,492

470,472
490,492

416,424
450,454

COLLAPSIBLE SUNSHADE FOR CASUAL SEATING

BACKGROUND OF THE INVENTION

1. Field of the Invention

This invention relates to casual seating, in general, and to collapsible reclining loungers, patio chairs and cots, in particular.

2. Description of the Related Art

Folding or collapsible chairs in the nature of furniture have been described in such U.S. Pat. as No. 3,635,520 (Roher et al) and U.S. Pat. No. 5,984,406 (Lee). In a multiple seat arrangement, they are also described in U.S. Pat. No. 5,570,928 (Staunton et al). For outdoor use, in camping and watching sports games, chairs of this type have been illustrated in U.S. Pat. No. 5,893,605 (Chang). When a reclining chair is desired for camping, hiking, fishing, and concert events, a construction of the type shown in U.S. Pat. No. 5,882,068 (Levine) is said to be useful.

While chairs of these types may prove adequate to suit their intended purposes, they have proven deficient when employed at beaches or seashore locations where users prefer low seat heights, typically no more than 6" to 10" above ground. While adjustments for multiple reclining positions in these chairs are highly desirable, the need for adjusting the position safely and easily is equally as important. As the reclining chair is oftentimes left unoccupied when open, it is almost as important, if not more so, for the beach chair to have a degree of stability about it, so as to limit its propensity to be blown about by wind gusts, as well as when being sat upon by a user. These various features, however, are not readily available with the type of folding lounge chair arrangements that typify the prior art—whether the folding lounger is used at the beach, at the seashore, or just in one's backyard.

At the same time, where simply used as a non-reclining patio chair, the acceptability of a folding chair depends in large part upon its strength and reliability of operation. In these two areas, the folding chair of the Lee Patent (No. 5,984,406) falls somewhat short.

To address these limitations, therefore, I have invented a new and improved recliner lounge and a new and improved patio chair. The lounge chair, described in an Application filed Apr. 18, 2000, entitled "Collapsible Reclining Beach Chair" (Ser. No. 09/551,664), now U.S. Pat. No. 6,179,374 incorporates a frame having pairs of crossed front, rear and side legs, with each leg including a pair of bends in opposing directions to allow bringing the seat level of the chair closer to the ground, and with connectors for the legs and a tilt-locking mechanism for stabilizing the chair and positively fixing it at the reclining angle set when opened or folded—and for collapsing the chair to a compact package when closed.

My second improvement, on the other hand, described in application Ser. No. 09/561,339, filed Apr. 28, 2000, and entitled "Collapsible Patio Chair" (now, U.S. Pat. No. 6,322,138, describes a patio chair incorporating a frame having left and right hand rests and pairs of crossed front, rear and side legs, and with connectors for stabilizing the chair when opened and for collapsing the chair to a compact package when closed. With front pad and rear pad connectors, and with rear connectors all being configured with generally perpendicular walls to apertures of which upper and lower ends of both rear legs and one side leg are pivotally connected, the hand rests are automatically folded as the chair is being collapsed, when front connectors employed include a notch within which the upper end of both front crossed legs are arranged to glide in forming the support for the hand rests, and to which an upper end of the other side leg is also pivotally connected.

I have also gone further in this area of casual seating to invent a new and improved collapsible cot, which can easily be carried about, and which is far lighter in weight than conventional cots and hammocks employed at a backyard setting, whose bulky frame typically stays outdoors the whole season, exposed to the elements. Such cot, also automatically folded as the cot is being collapsed, is described in my application Ser. No. 09/593,938, filed Jun. 15, 2000, entitled "Collapsible Cot".

As will become clear from the following description, the present invention relates to these areas of casual seating, but more particularly, relates to sunshades employable with any and all of these reclining loungers, patio chairs and cots of my improved designs—with the sunshade being characterized by itself being collapsible, so as to be folded when either the lounger, the patio chair, or the cot with which it is used is being collapsed to their individual compact package.

SUMMARY OF THE INVENTION

As will become clear from the following description, the reclining beach chair or lounger of application Ser. No. 09/551,664, U.S. Pat. No. 6,179,374, with which the collapsible sunshade of the present invention is particularly useful, replaces the straight leg "X" tubing which characterizes standard designs by an "X" shape tubing incorporating pairs of bends to allow for bringing the seat level of the chair closer to the ground. By replacing the oftentimes used "brake lock" (for free-hand adjustment in sliding the chair back to the desired incline position) with a "positive" slide lock in which a "snap" is secured within a capturing aperture, a true, predetermined locking position results once the recline is set. As will be further described, to increase stability, the reclining lounger is constructed to effectively push forward its center of gravity, as by making the rear legs of the chair longer than the front legs. Where desired, a bar can also be fixed between opposing left and right sides of the chair frame back to further stabilize the chair when extended to an open position. In accordance with its invention, both the chair and the stabilizer bar are easily collapsible into a compact package to facilitate the carrying about and storage of this recliner.

The collapsible patio chair of application Ser. No. 09/561,339, U.S. Pat. No. 6,322,138, on the other hand, consists of a frame including pairs of front crossed legs and rear crossed legs, and two pairs of side crossed legs, with each pair of crossed legs being pivotally connected together where they cross; first and second front pad connectors pivotally connected to lower ends of one of the front crossed legs and one of the side crossed legs, respectively; first and second rear pad connectors pivotally connected to lower ends of one of the rear crossed legs and the other of the side crossed legs, respectively; first and second front connectors pivotally connected to upper ends of the one front crossed leg and the other of the side crossed legs, respectively; first and second rear connectors pivotally connected to upper ends of the rear crossed legs and the one side crossed leg, respectively; a pair of side supports passing through apertures in each of the first and second rear connectors having lower ends fixedly connected to the rear pad connectors; and a fabric liner connected to the first and second front connectors and to upper ends of the pair of side supports.

In accordance with this patio chair invention, to provide strength and reliability of operation beyond that characterizing the patented Lee design, the front connectors include a top surface having a notch therein open at one end and slightly larger than the diameter of the front crossed legs when composed as a tubular configuration, a first wall at an underside thereof defining one side of the notch and to which the upper ends of the front crossed legs are pivotally connected and a second wall at the underside, generally perpendicular to the first wall and combined therewith, to which the upper ends of the other of the side crossed legs are also pivotally connected. In like manner, each of the front and rear connector pads (as well as the rear connectors) include the two generally perpendicular walls for fastening with their respective pivotally connected legs -while the rear connector pads include apertures at the join of the two walls where the side supports are fixed.

The collapsible cot of application Ser. No. 09/593,938, furthermore, consists of a frame including two pairs of front crossed legs, two pairs of rear crossed legs, and three pairs of side crossed legs, with each pair of crossed legs being pivotally connected together where they cross. First, second and third front pad connectors are included to pivotally connect to lower ends of the front crossed legs and to individual ones of the side crossed legs—while first, second and third rear pad connectors pivotally connect to lower ends of the rear crossed legs and to individual ones of others of the side crossed legs. First, second and third front connectors pivotally connect to upper ends of the front crossed legs and to individual ones of the side crossed legs, while first, second and third rear connectors pivotally connect to upper ends of the rear crossed legs and to individual ones of others of the side crossed legs. A fabric liner is included connected to two of the front connectors and to two of the rear connectors—and, in completing a preferred construction, a pair of side extenders are pivotally coupled to one of the front crossed legs and to one of the rear crossed legs, where they are joined with the fabric liner for a user to rest upon.

In accordance with this collapsible cot invention, to provide strength and reliability of operation, the front connectors where the two side extenders couple include a top surface having a notch therein open at one end and slightly larger than the diameter of the crossed legs when composed as a tubular configuration, a first wall at an underside thereof defining one side of the notch and to which the upper ends of the crossed legs are connected, along with a second wall at the underside, generally perpendicular to the first wall and combined therewith, to which the upper ends of the others of the crossed legs are also pivotally connected. In like manner, each of the remaining pad connectors include the two generally perpendicular walls for fastening with their respective pivotally connected legs.

In one embodiment of the collapsible cot invention, the side extenders are each pivotally coupled to their associated front crossed leg and to their rear crossed leg at a point below the connector which joins them, whereas in a second embodiment, the sides extenders are pivotally coupled at a point above the connectors. In this first embodiment, various taps, fasteners, and overlying rings are employed to align the crossed legs and extenders together, and to secure them in position; in the second embodiment, hinges are employed to achieve this comparable result.

As will become clear from the following description, the sunshade of the present invention cooperates with each of these recliner loungers, patio chairs and cots so as to be usable and collapsible, and to fold with each of them as they are each being collapsed to their respective compact package.

BRIEF DESCRIPTION OF THE DRAWINGS

These and other features of the collapsible sunshade of the present invention will be more clearly understood from a consideration of the following description, taken in connection with the accompanying drawings, in which.

A. Ser. No. 09/551,664, U.S. Pat. No. 6,179,374, Collapsible Reclining Beach Chair

B. Ser. No. 09/561,339, U.S. Pat. No. 6,322,138, Collapsible Patio Chair

Figure 18:
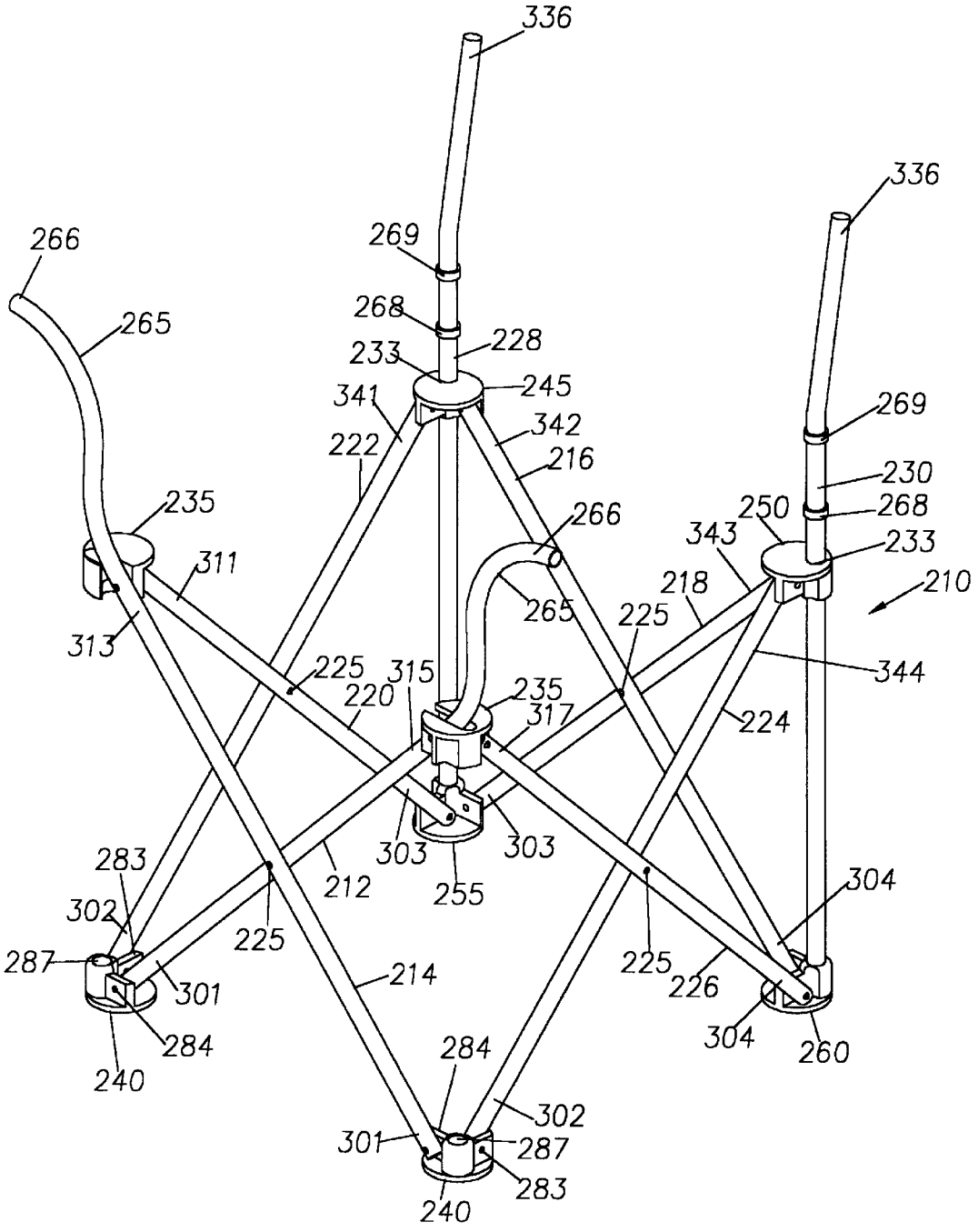
Figure 19:
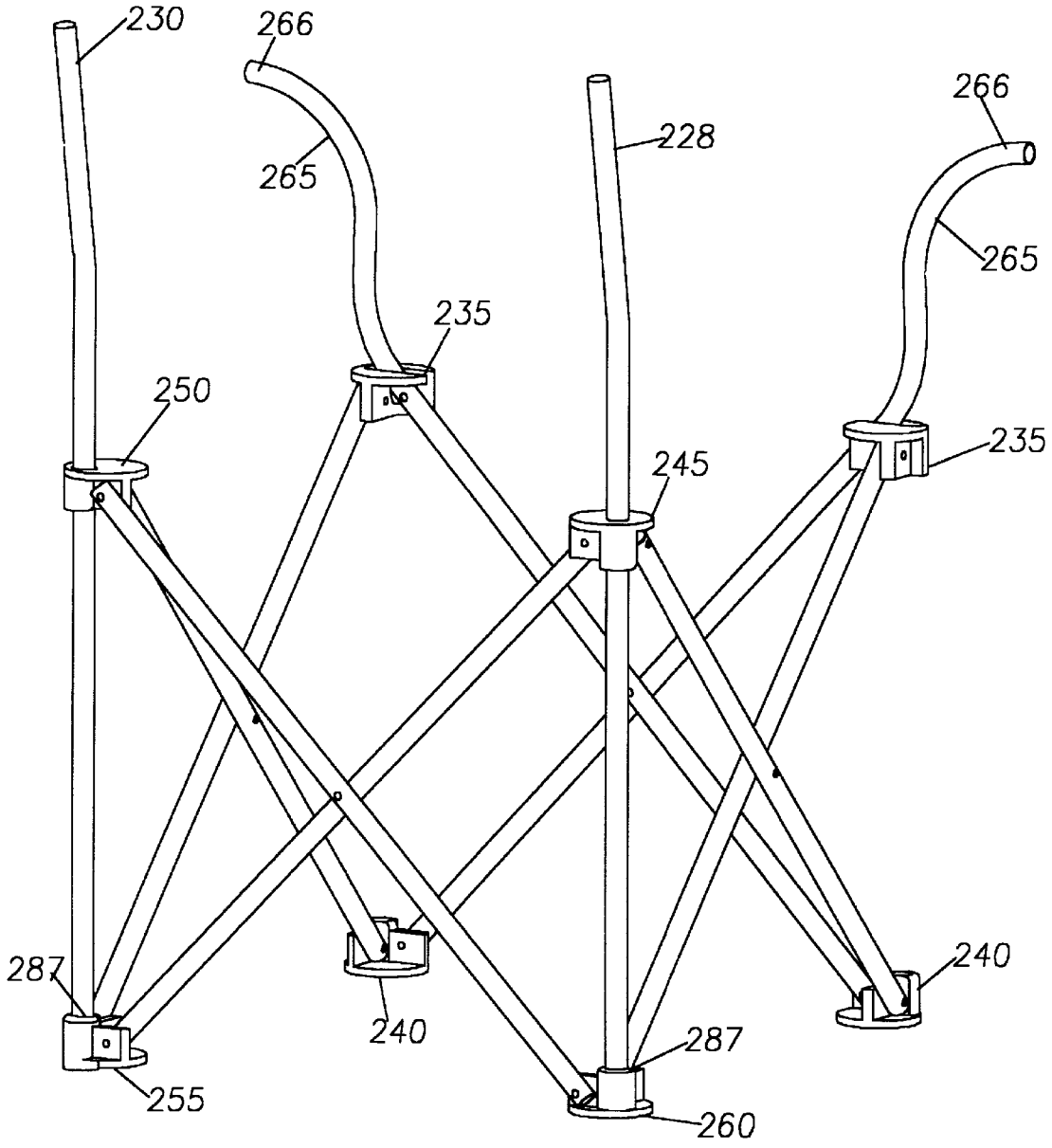
Figure 20:
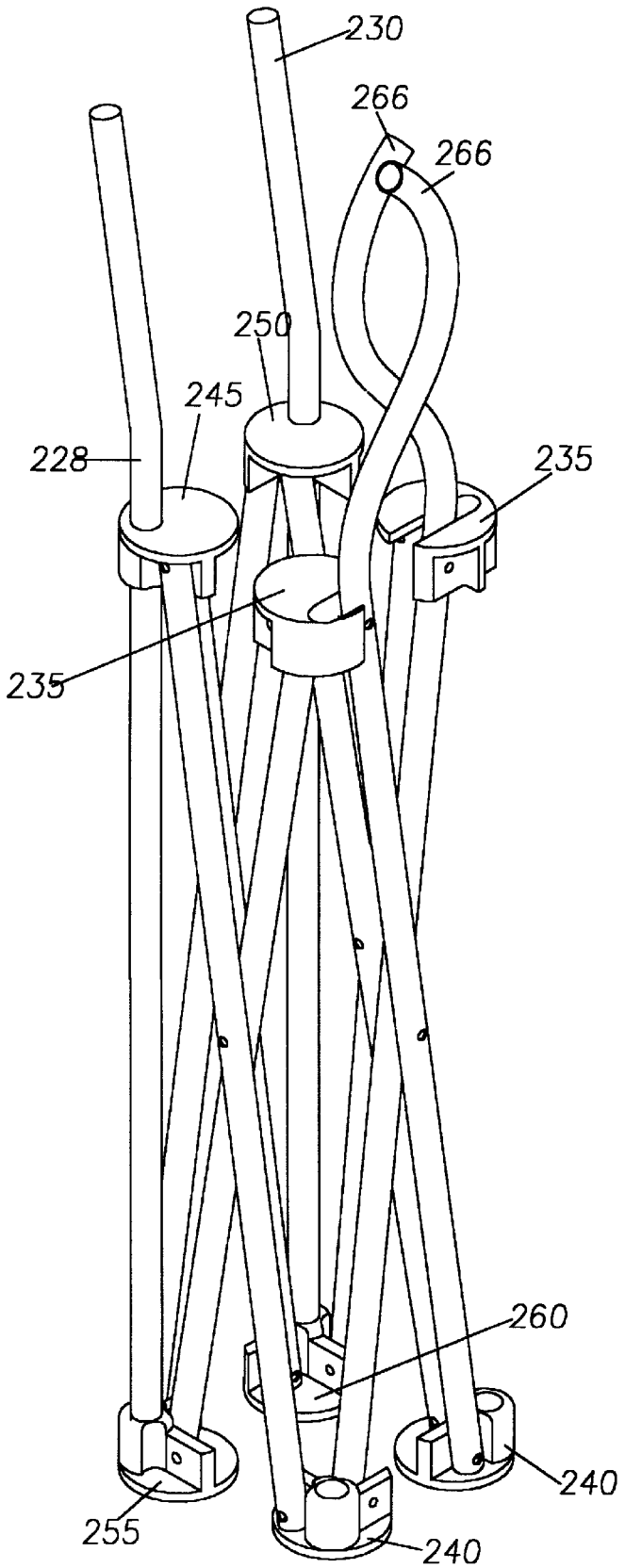
Figure 21:
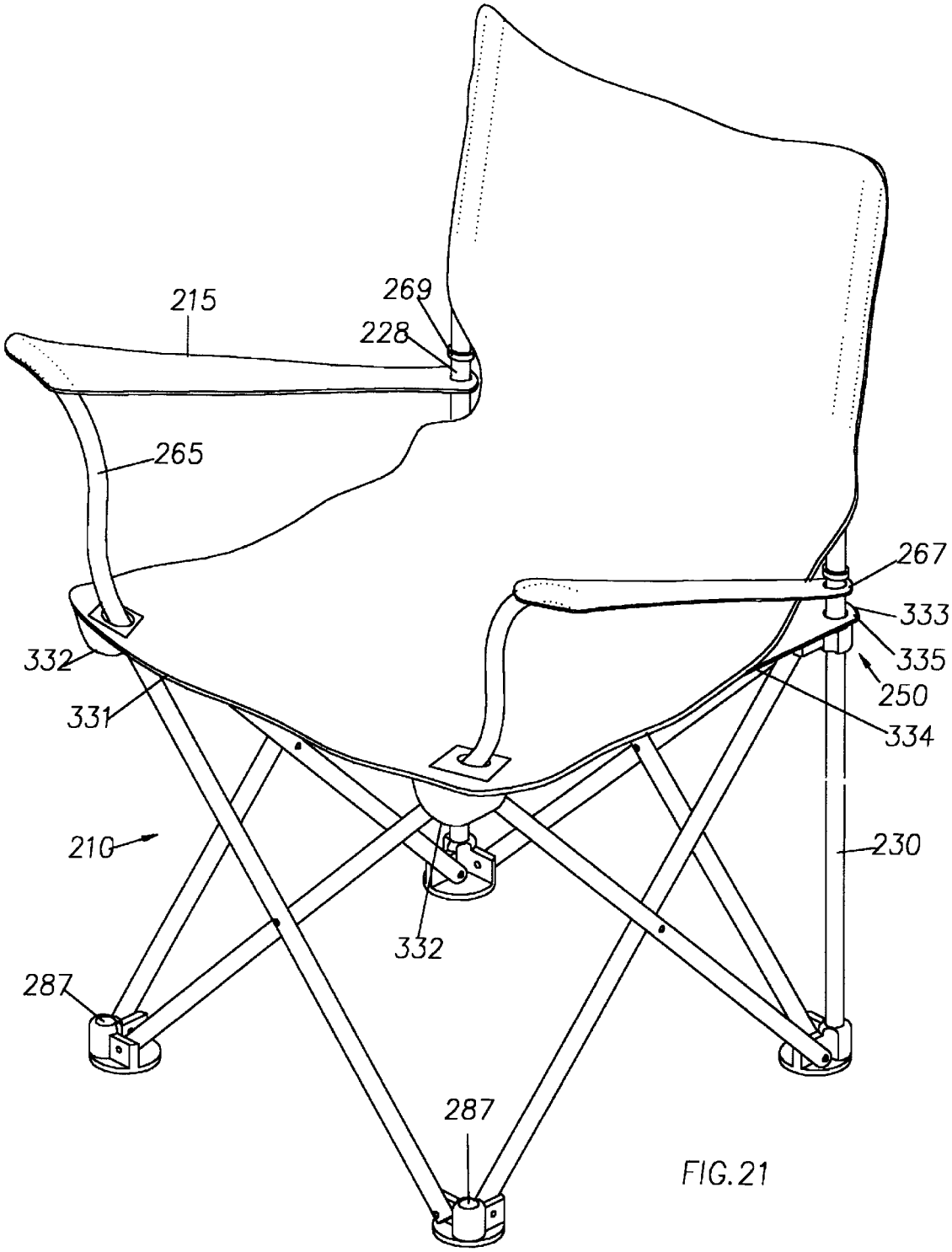
Figure 22A:
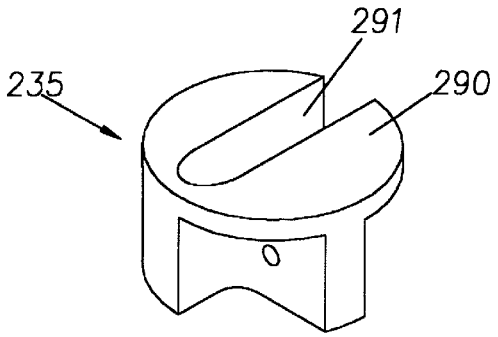
Figure 22B:
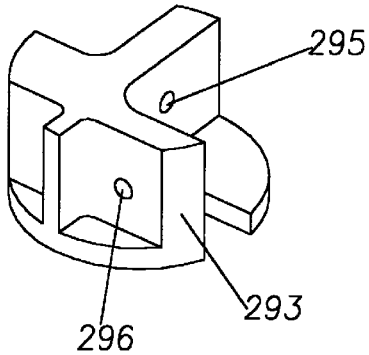
Figure 23A:
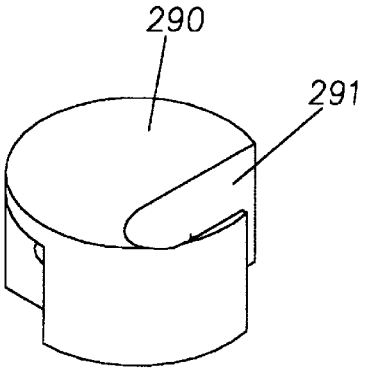
Figure 23B:
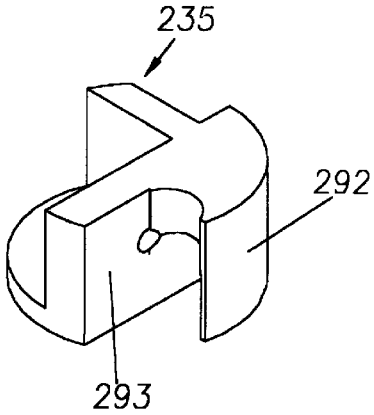
Figure 24B:
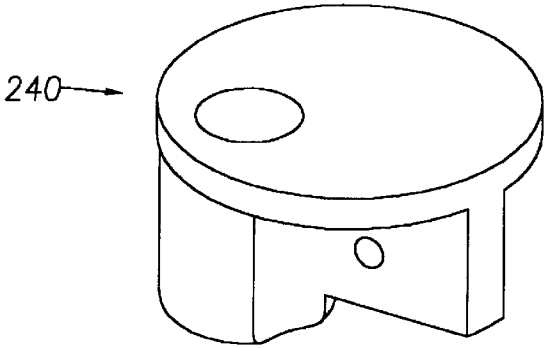
Figure 24A:
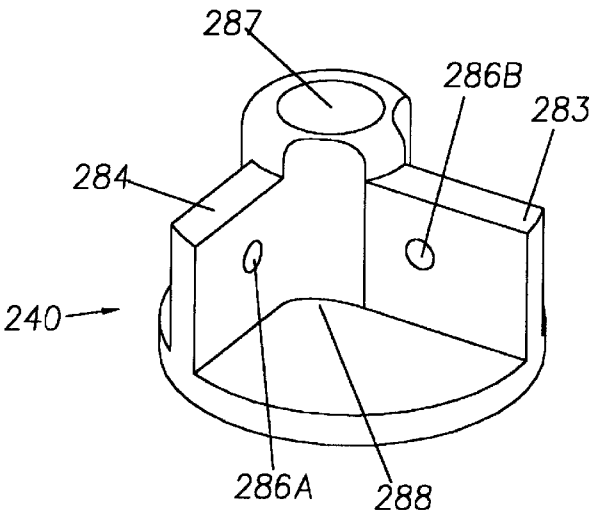
Figure 25B:
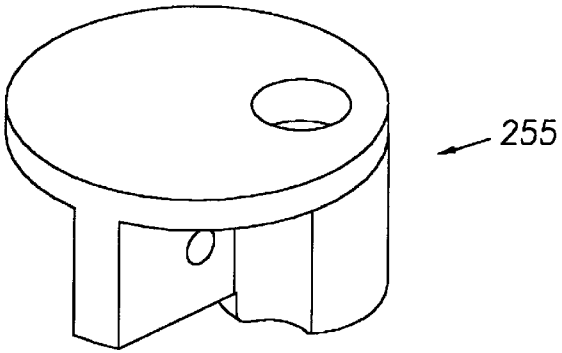
Figure 25A:
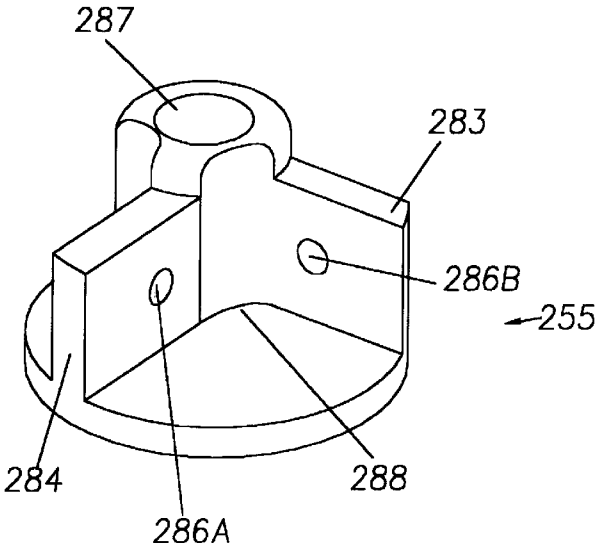
Figure 27A:
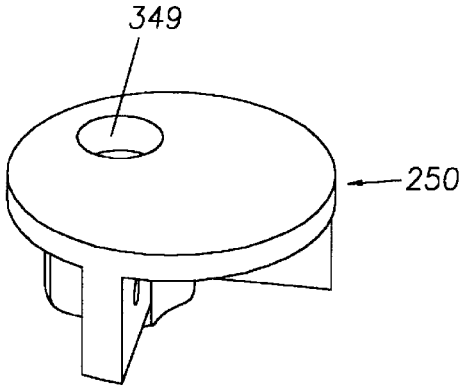
Figure 27B:
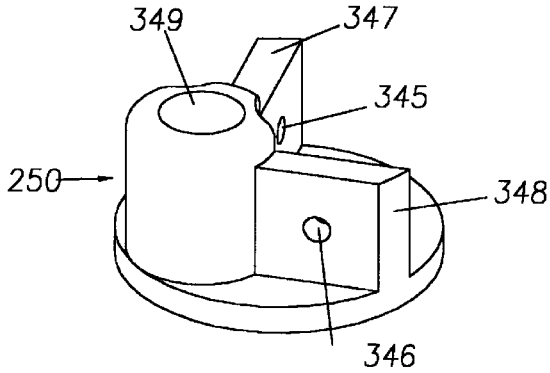
Figure 26A:
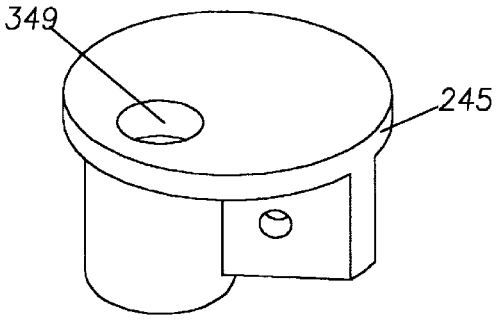
Figure 26B:
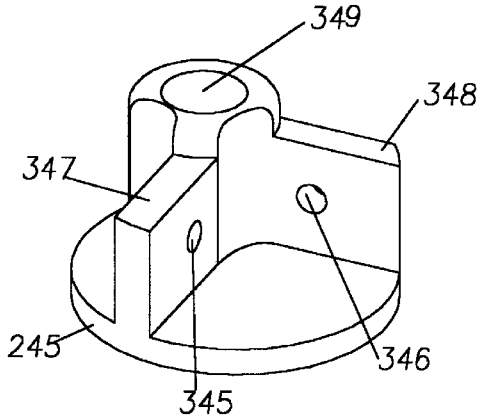

FIG. 18 is a front perspective view of the collapsible patio chair of the application Ser. No. 09/561,339, U.S. Pat. No. 6,322,138, invention in an unfolded position, with its seating fabric removed;

FIG. 19 is a rear perspective view of the patio chair in its unfolded position;

FIG. 20 is a front perspective view of the patio chair when fully collapsed, ready for storage;

FIG. 21 is a front perspective view of the collapsible patio chair in its unfolded position, with the seating fabric in place;

FIGS. 22A & 22B and 23A & 23B are top and bottom perspective views respectively of the front connectors of the patio chair of this application;

FIGS. 24A & 24B are top and bottom perspective views respectively of the front connector pads;

FIGS. 25A & 25B are top and bottom views respectively of the rear connectors pads; and FIGS. 26A & 26B and 27A & 27B are top and bottom perspective views respectively of the rear connectors of the patio chair invention.

C. Ser. No. 09/593,938, collapsible Cot

Figure 28:
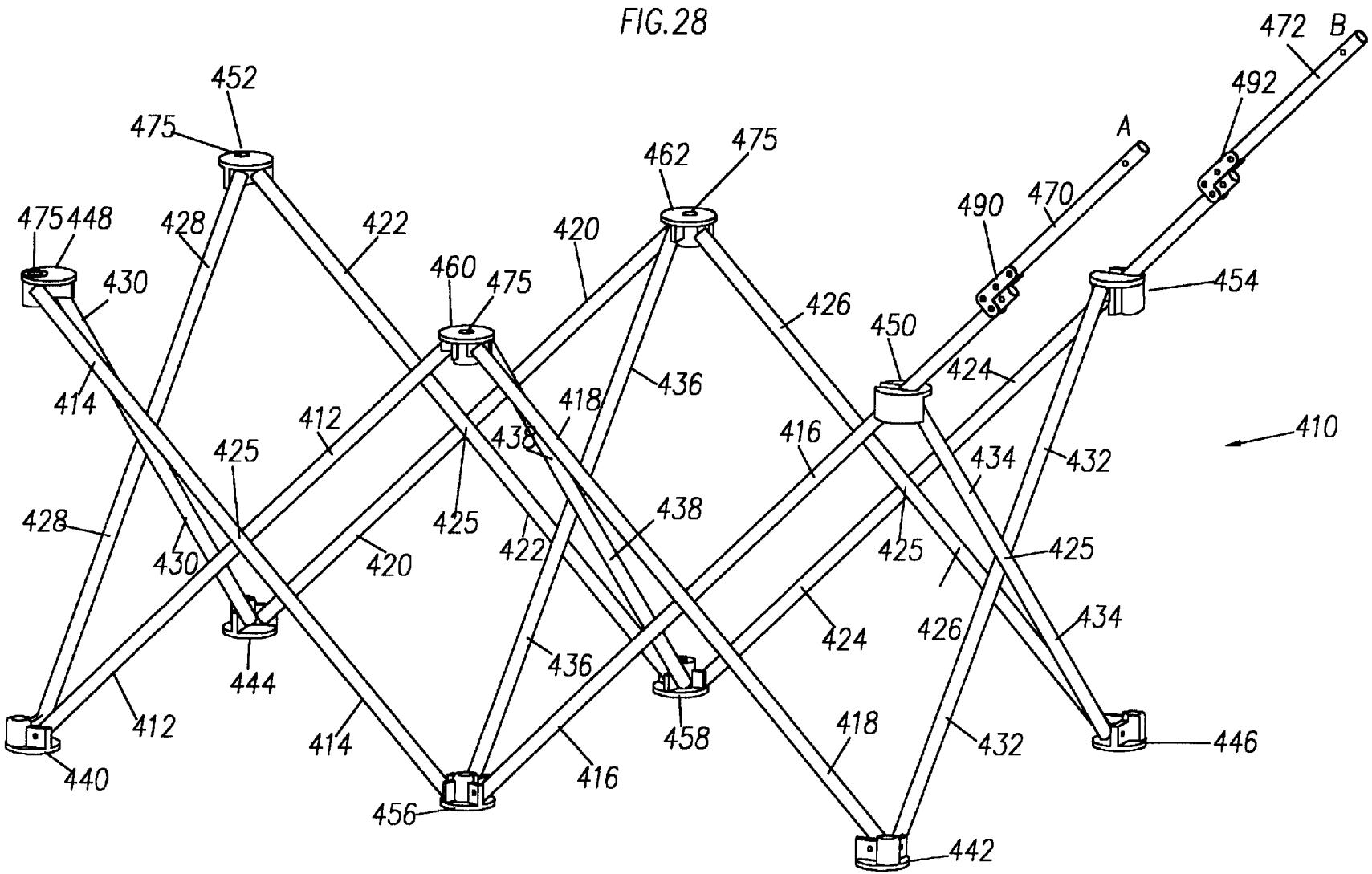
Figures 29A, 29B, 29C, 29D, 29E, 29F:
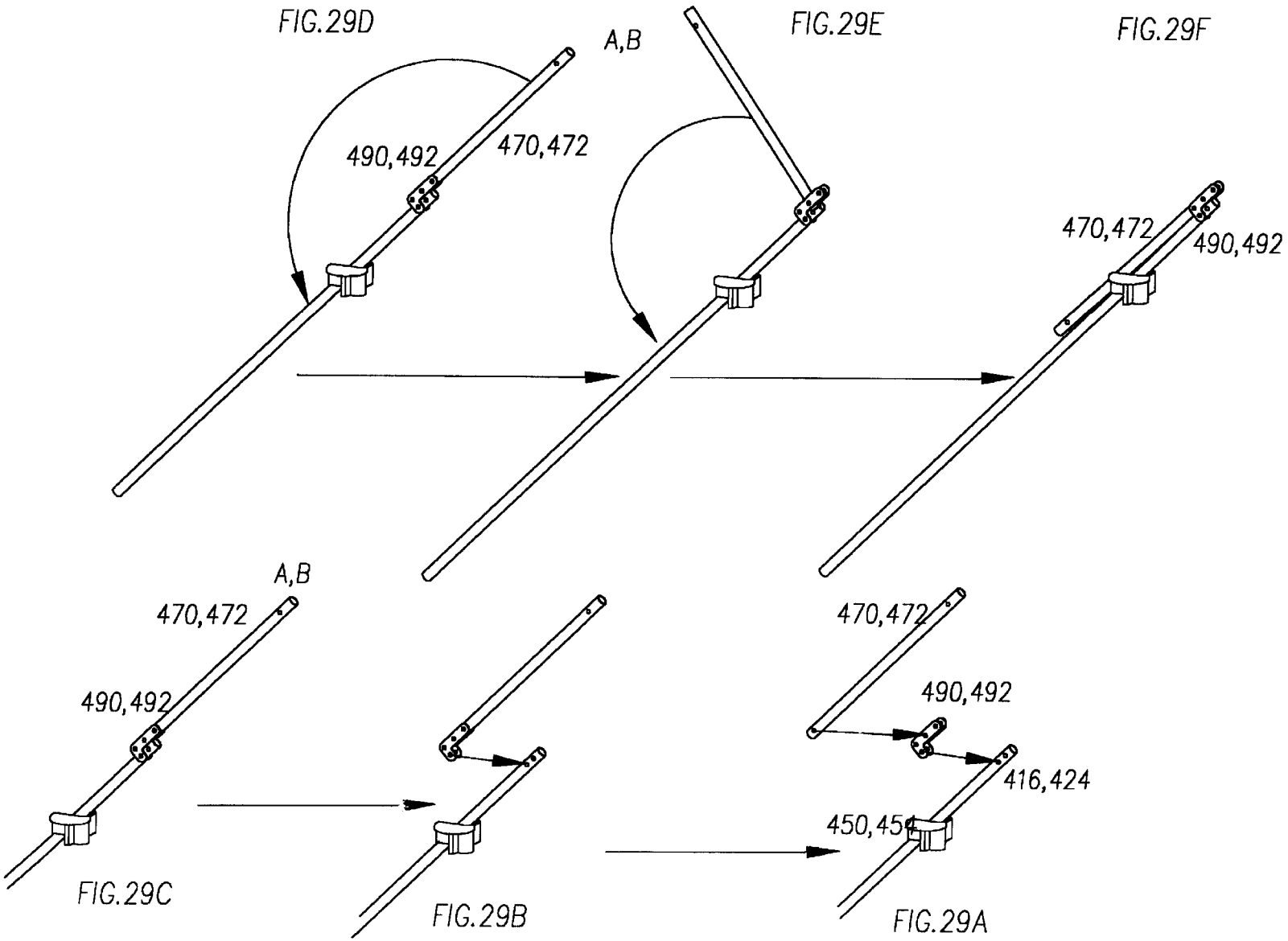
Figure 32B:
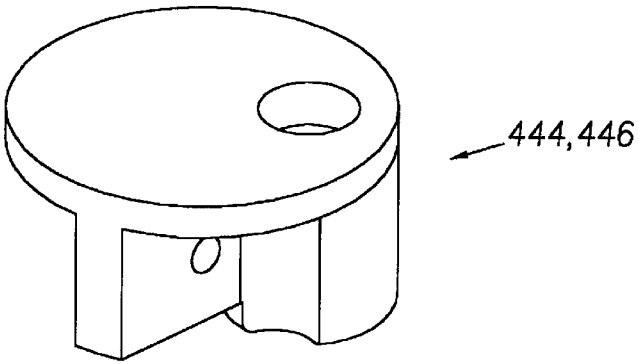
Figure 32A:
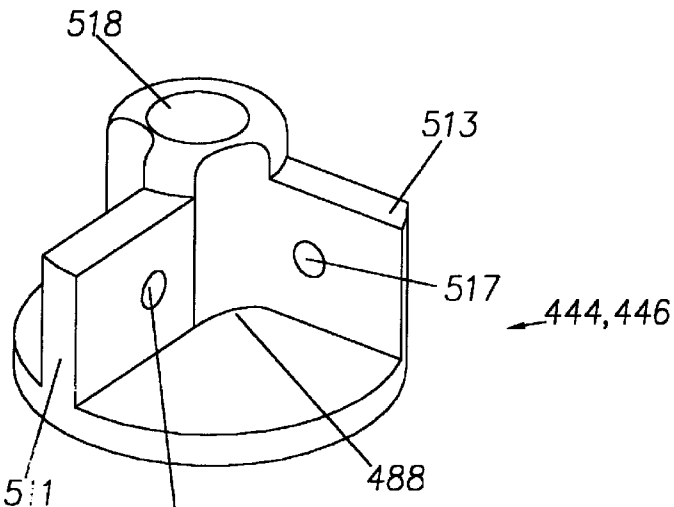
Figure 30B:
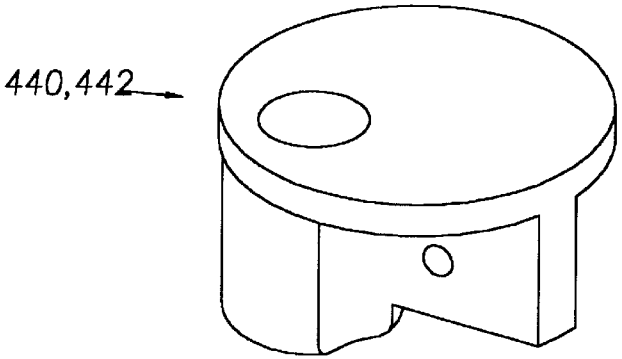
Figure 30A:
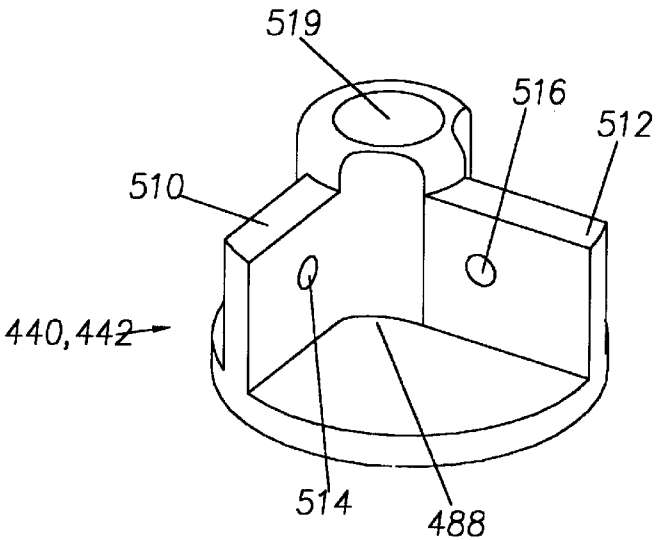
Figure 31B:
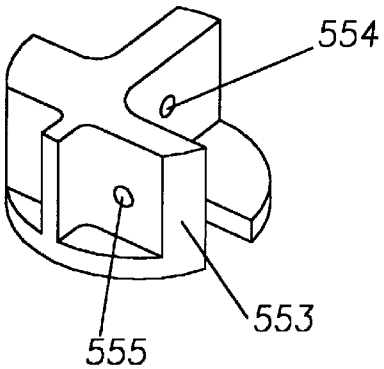
Figure 33B:
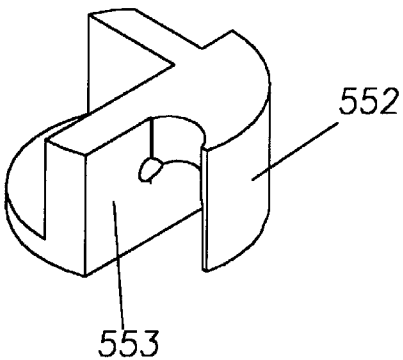
Figure 31A:
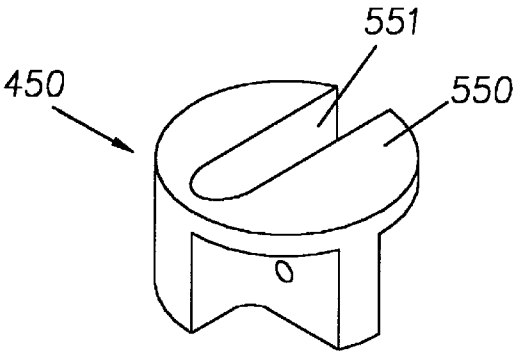
Figure 33A:
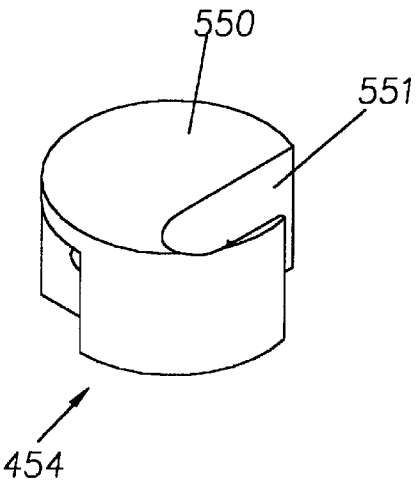
Figure 37B:
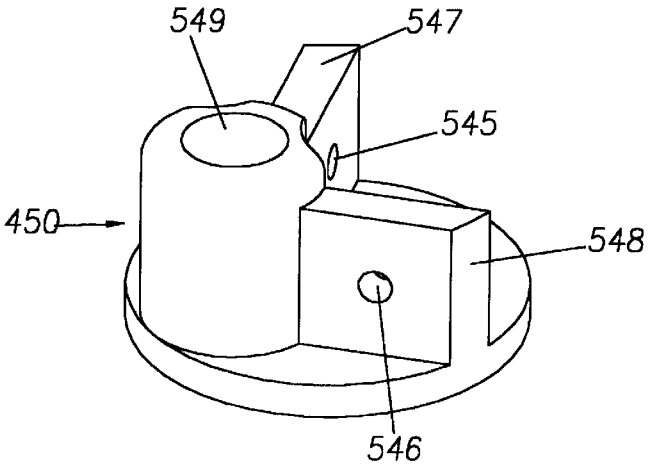
Figure 34B:
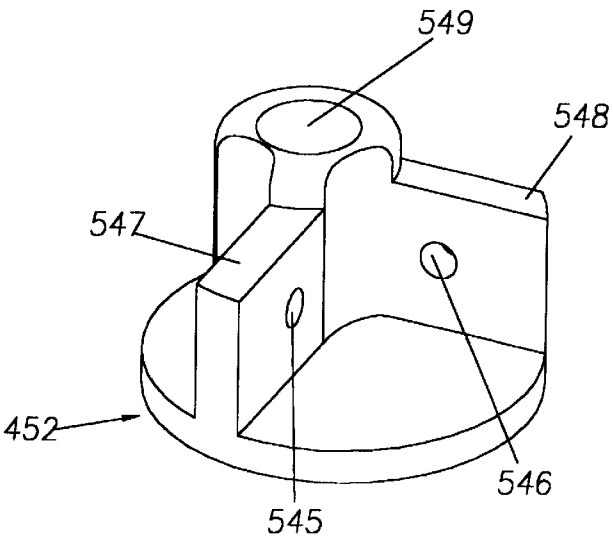
Figure 37A:
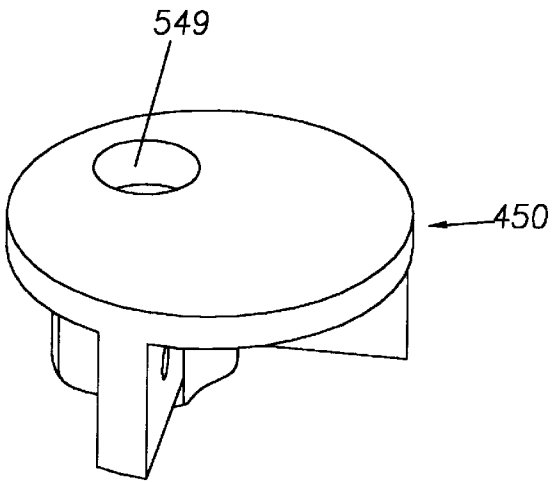
Figure 34A:
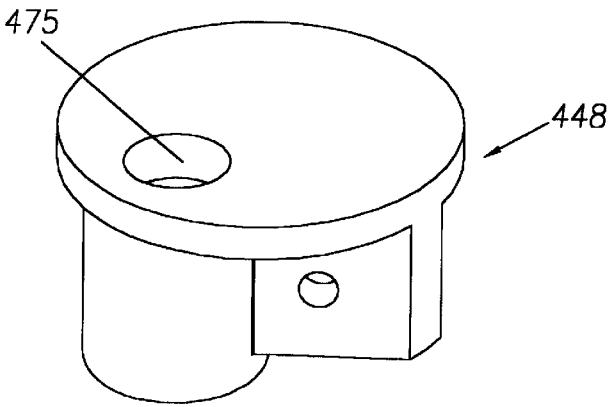
Figure 36A:
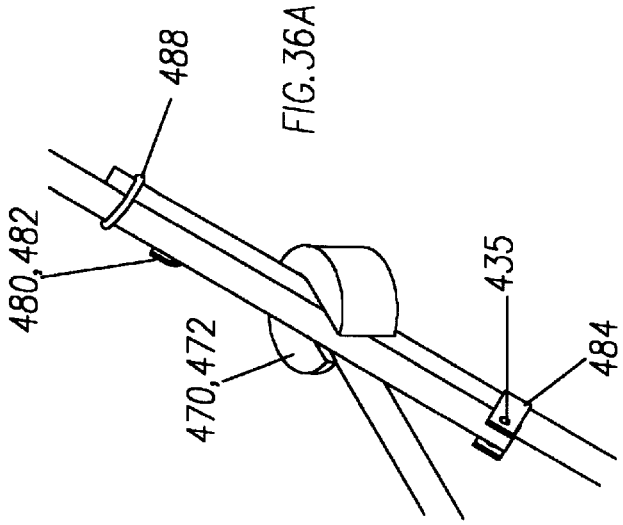
Figure 36B:
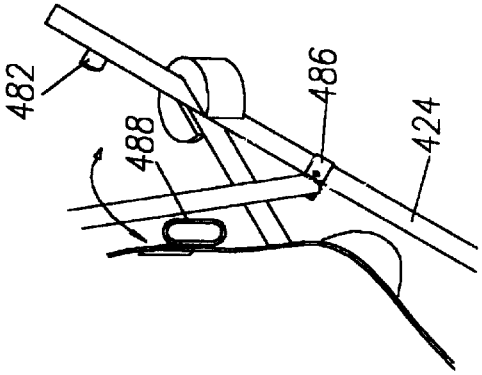
Figure 35:
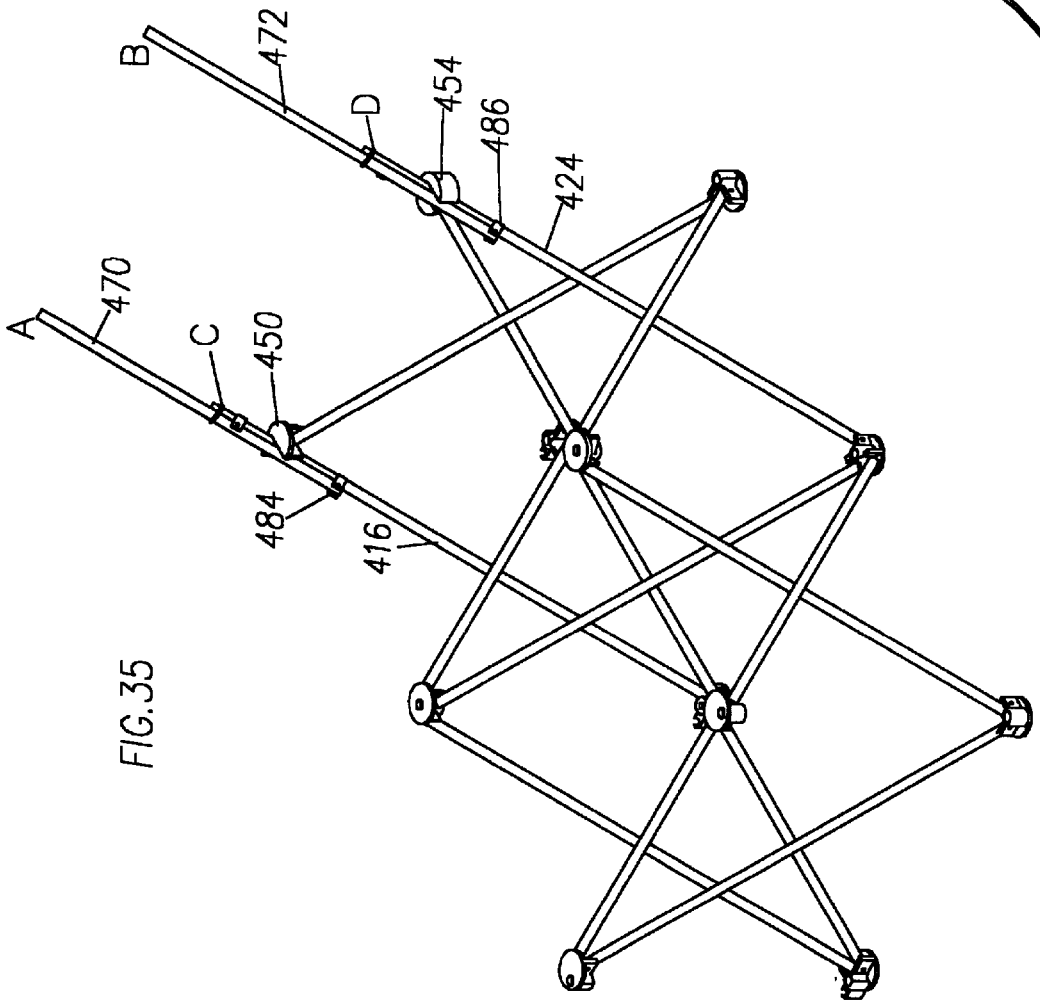
Figures 37, 38A, 38B, 38C:
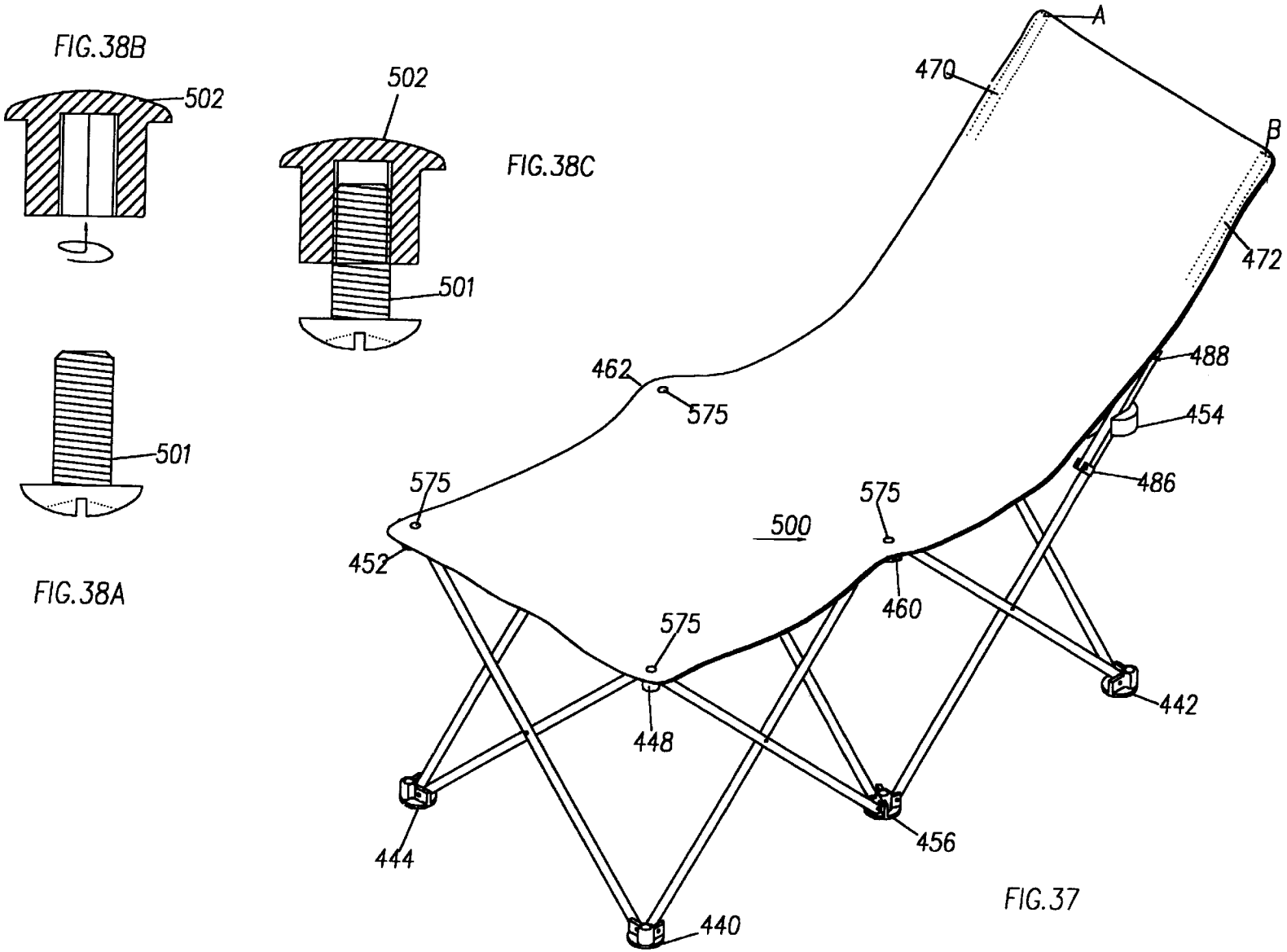

FIG. 28 is a front perspective view of the collapsible cot of the application Ser. No. 09/593,938, invention in an unfolded position, with its seating fabric removed;

FIG. 29A–29F are helpful in an understanding of the operation of the collapsible cot of FIG. 28;

FIGS. 30A & 30B are top and bottom perspective views, respectively, of two of the three front pad connectors of the collapsible cot;

FIGS. 31A & 31B are top and bottom perspective views, respectively, of a first front connector of the cot;

FIGS. 32A & 32B are top and bottom perspective views, respectively, of two of the three rear pad connectors of the cot;

FIGS. 33A & 33B are top and bottom perspective views, respectively, of the collapsible cot's first rear connector;

FIGS. 34A & 34B are top and bottom perspective views, respectively, of the cot's second front connector and second rear connector;

FIG. 35 is a front perspective view of the collapsible cot of this Application also in an unfolded position with its seating fabric removed, in accordance with a second construction of the cot;

FIGS. 36A & 36B are views helpful in an understanding of the construction of FIG. 35;

FIG. 37 illustrates the construction of the collapsible cot of FIG. 35 with the seating fabric in place, but is also helpful in an understanding of the installation of the seating fabric in the first construction of FIG. 28; and FIGS. 38A, 38B and 38C are sectional views helpful in understanding one manner of securing the seating fabric as a liner for the collapsible cot of FIG. 28.

D. Collapsible Sunshade of the Present Invention

Figure 1:
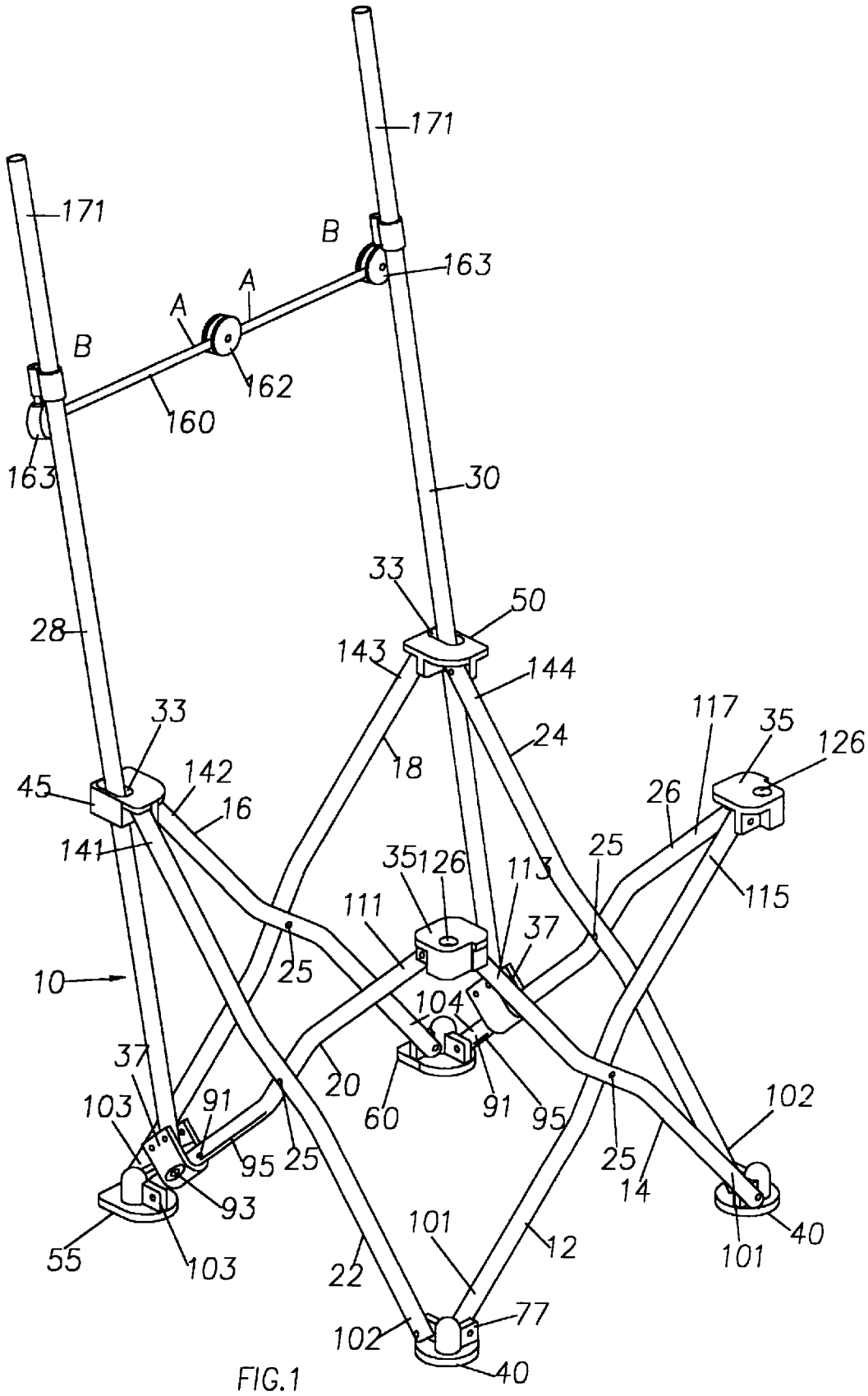
FIG. 1 is a front perspective view of the collapsible reclining beach chair or lounger of the application Ser. No. 09/551,664, U.S. Pat. No. 6,179,374, invention in an unfolded position, with its seating fabric removed.
Figure 39:
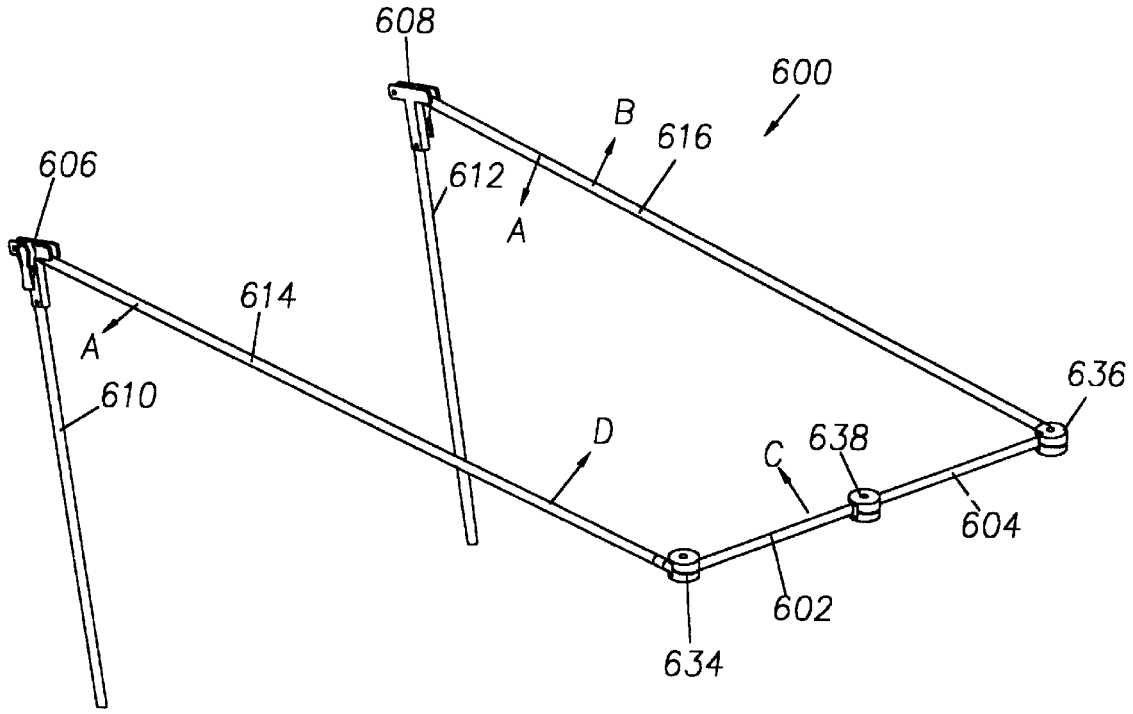
Figure 44A:
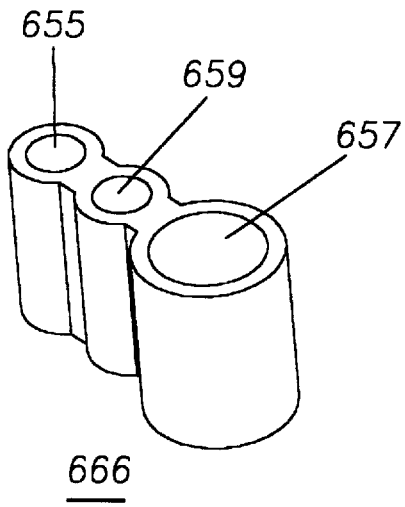
Figure 44B:
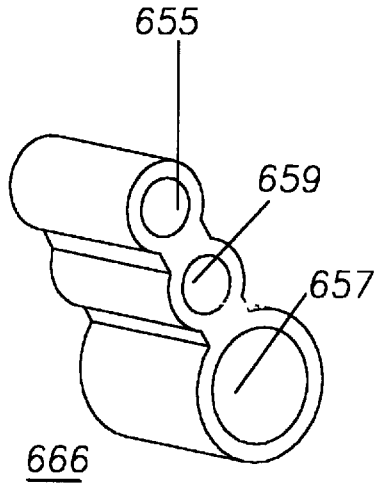
Figure 45:
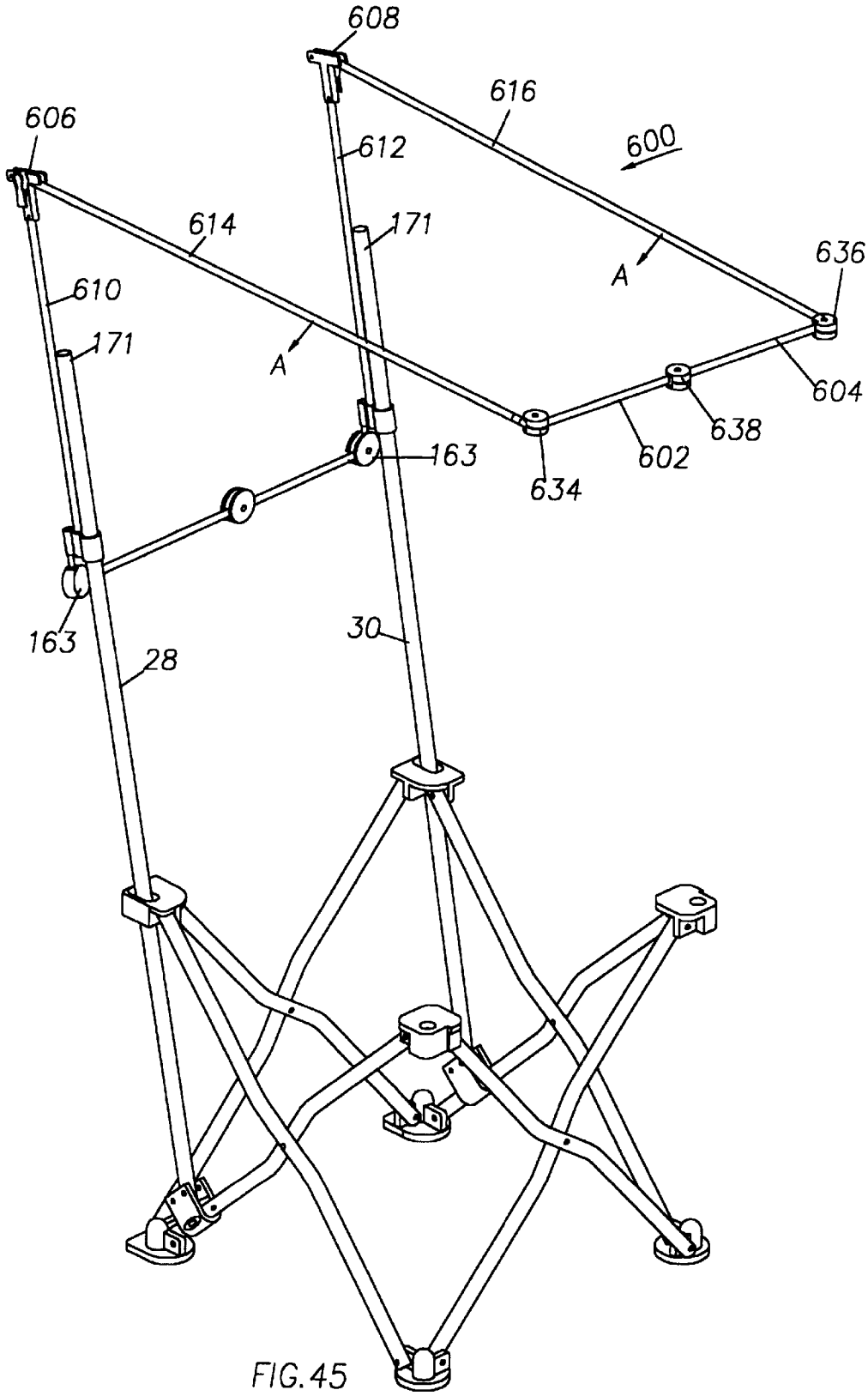
Figure 46:
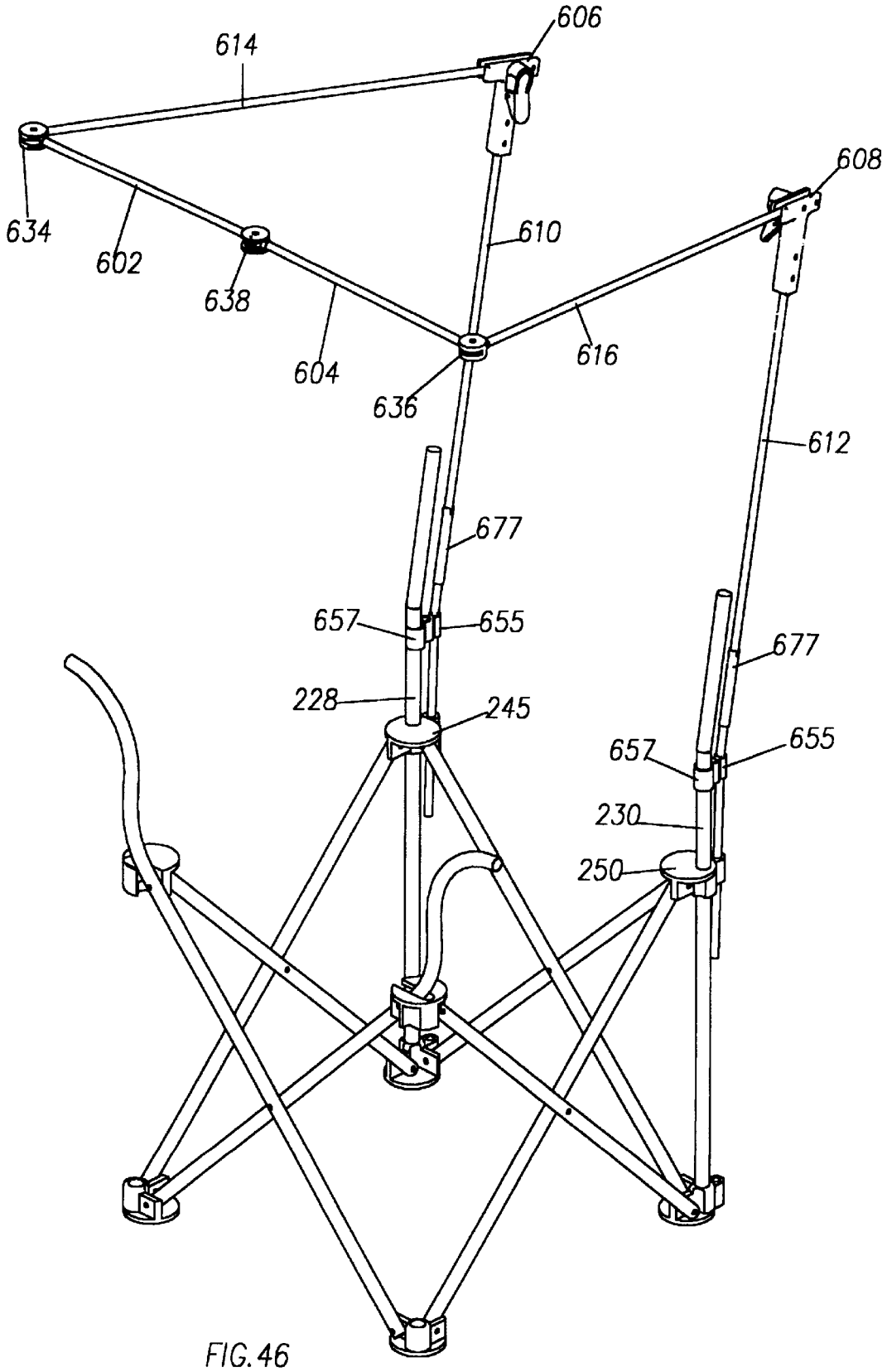
Figure 47:
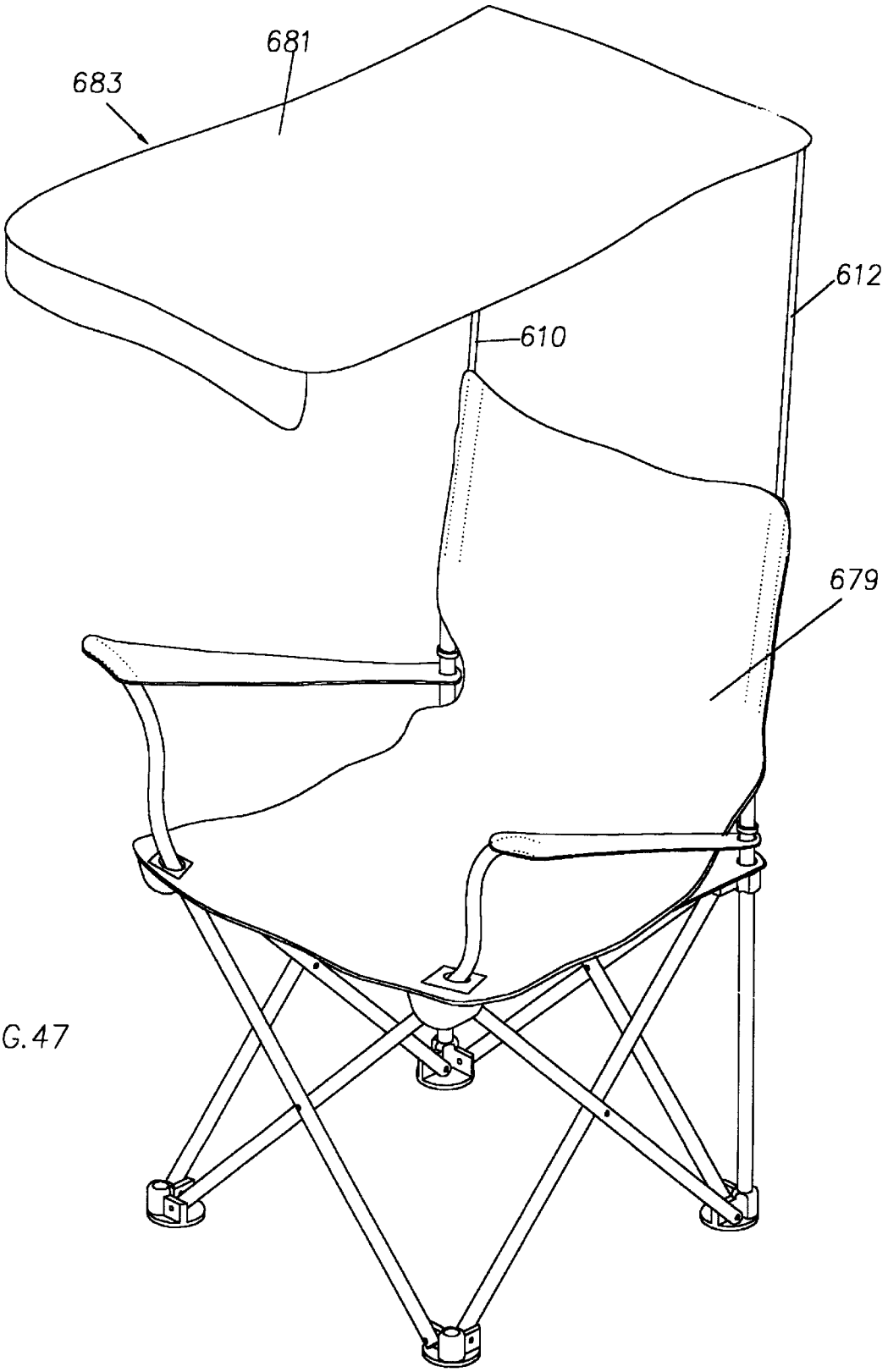
Figure 48:
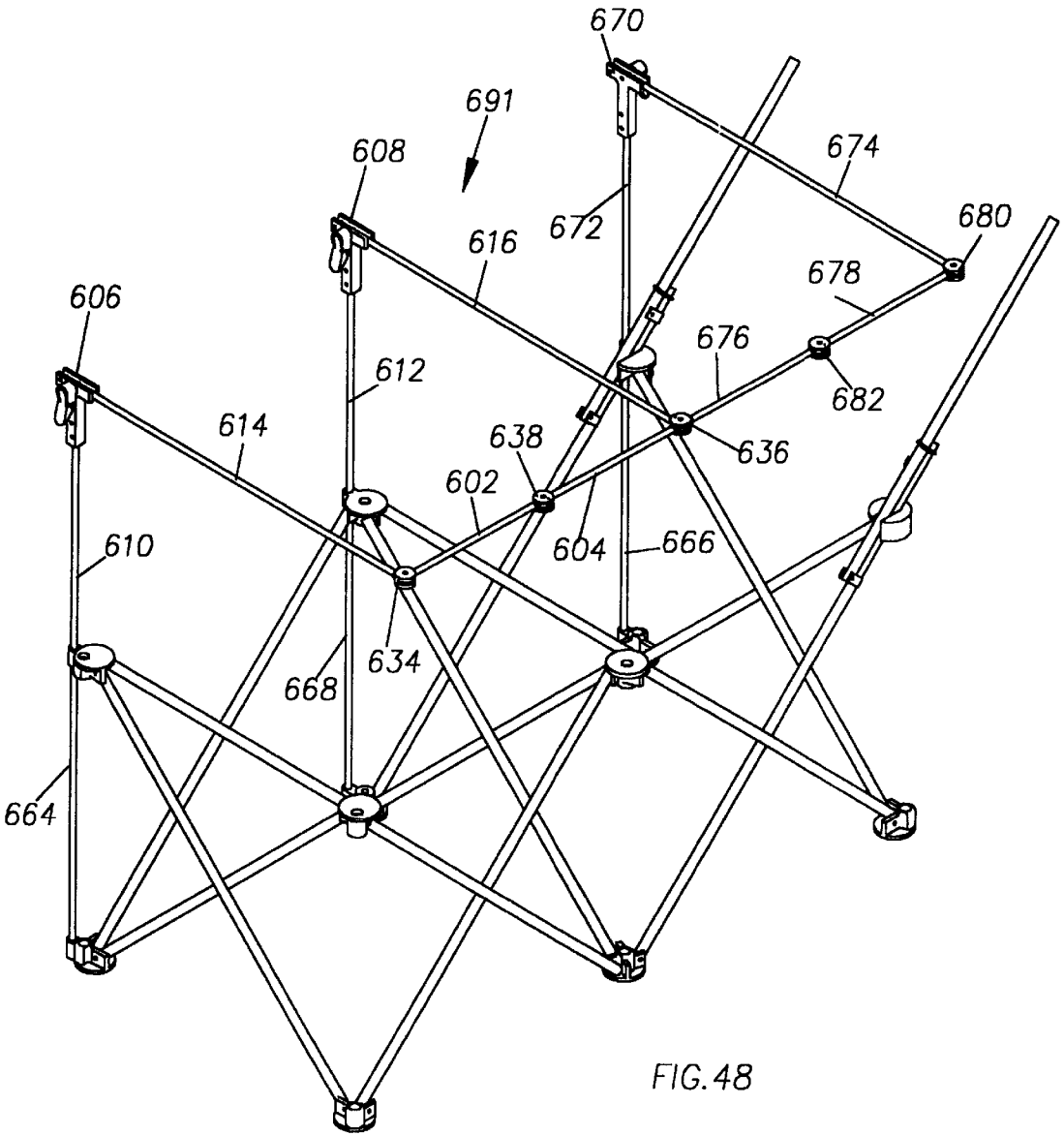
Figure 49:
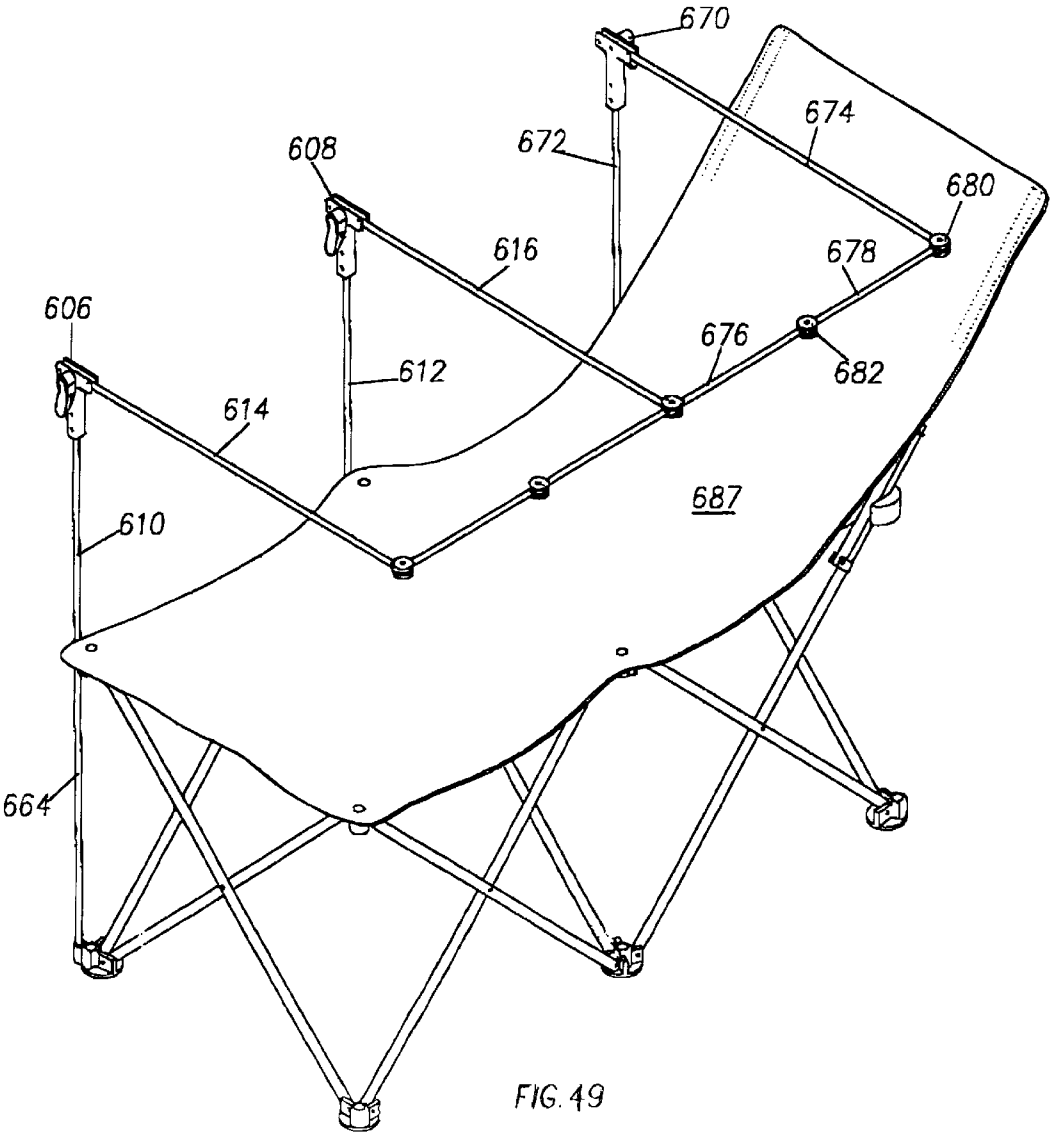
Figure 50B:
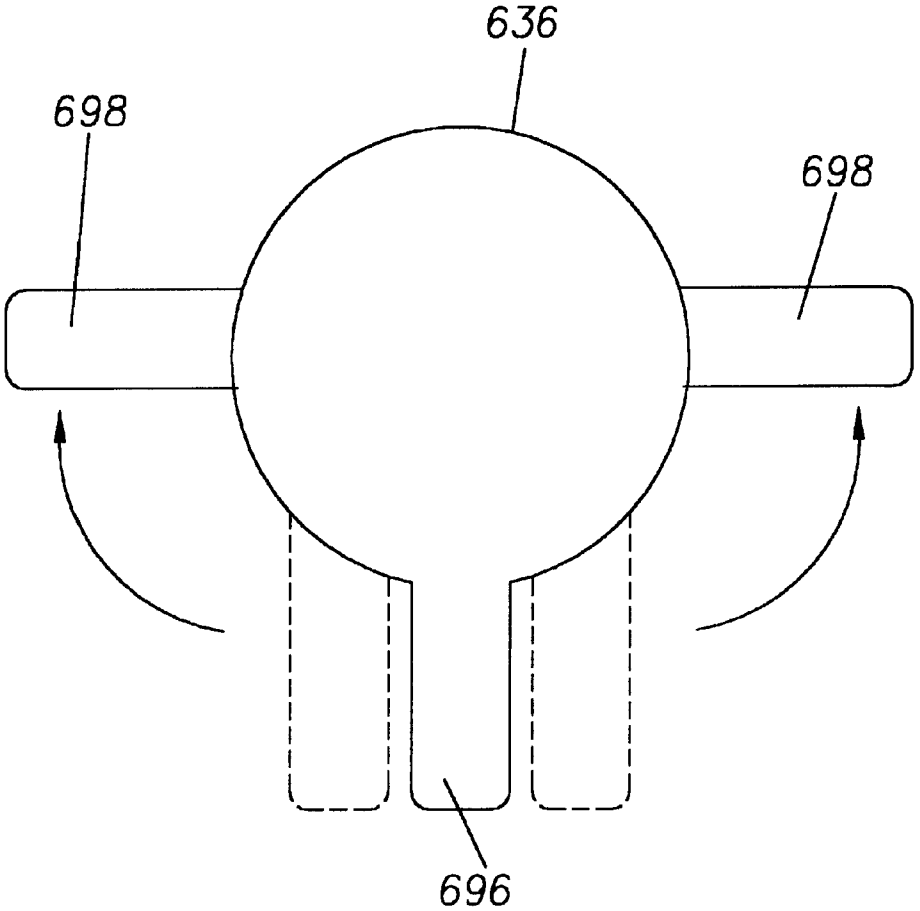
Figure 50A:
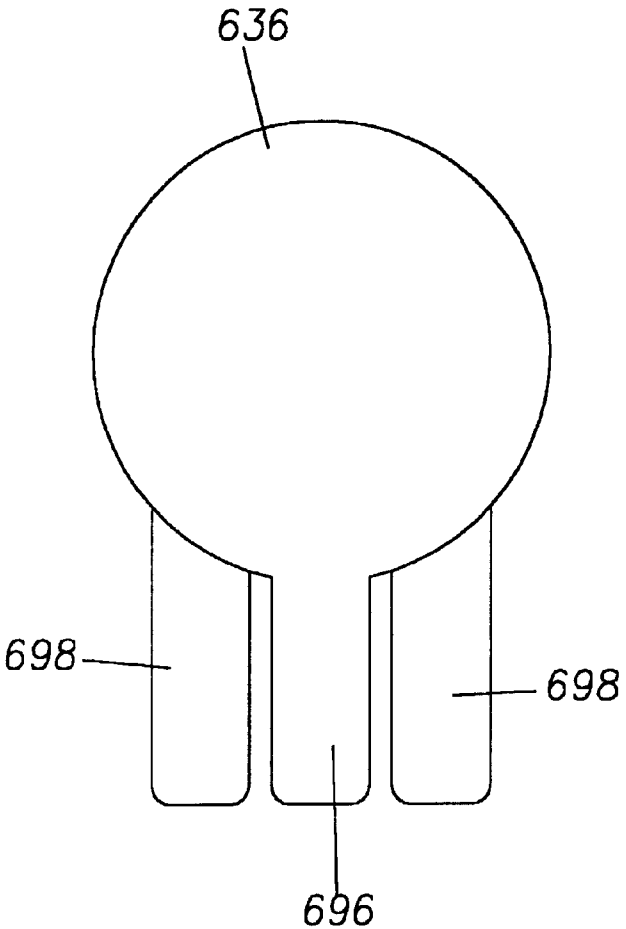

FIG. 39 is a front perspective view of the collapsible sunshade of the present invention, with its canopy fabric covering removed;

FIGS. 4A–40D and 41A–41D are top perspective views of various pivot hinge components of the sunshade which allow the sunshade to be opened for use, and then to be folded for storing away when the lounger, patio chair or cot in conjunction with which it is being used is collapsed;

FIGS. 42A–42C and 43A–43C are front and sectional views helpful in an understanding of the elbows of the sunshade which secure its canopy in position;

FIGS. 44A and 44B are top and bottom perspective views of a modification to a component of the reclining beach chair of FIG. 1 needed to support the collapsible sunshade of the present invention;

FIG. 45 is a front perspective view of the collapsible reclining beach chair or lounger of my application Ser. No. 09/551,664, U.S. Pat. No. 6,179,374 invention, as thus modified, in an unfolded position, with its seating fabric removed, and with the collapsible sunshade of the present invention in its opened position, but with its canopy fabric covering removed;

FIG. 46 is a front perspective view of the collapsible patio chair of my application Ser. No. 09/561,339, U.S. Pat. No. 6,322,138 invention in an unfolded position, with its seating fabric removed, and with the collapsible sunshade of the invention opened but with its canopy fabric covering also removed;

FIG. 47 is a front perspective view of the collapsible patio chair with its seating fabric in place and with the sunshade opened for use;

FIG. 48 is a front perspective view of the collapsible cot of my Ser. No. 09/593,938 Application in an unfolded position, modified to accept the collapsible sunshade of this invention, with its seating fabric removed and with the canopy fabric covering removed as well;

FIG. 49 illustrates the collapsible cot of FIG. 48 with its seating fabric in place and with the canopy of the sunshade opened for use; and FIGS. 50A and 50B are top perspective views helpful in an understanding of a modified pivot hinge for opening and closing the sunshade for the collapsible cot of FIGS. 48 and 49.

DETAILED DESCRIPTION OF THE INVENTION

A. Ser. No. 09/551,664, U.S. Pat. No. 6,179,374 Collapsible Reclining Beach Chair As with the folding chair of U.S. Pat. No. 5,984,406, the collapsible reclining beach chair or lounger of the application Ser. No. 09/551,664, U.S. Pat. No. 6,179,374 invention is constructed out of tubular members. In FIG. 1, the frame of the beach chair 10 includes eight crossed legs in pairs of two each—front legs 12, 14, rear legs 16, 18, and side legs 20, 22 and 24, 26. As illustrated, each of the pairs 12 & 14, 16 & 18, 20 & 22 and 24 & 26 are joined together by pivot pins 25. The frame 10, furthermore, includes a pair of side supports 28, 30—which, like the crossed legs 12 & 14, 16 & 18, 22 and 24 are tubular, and are constructed of aluminum or steel. The side legs 20 and 26, on the other hand, are constructed of extruded aluminum tubing, the reason for which is explained below.

Figure 2:
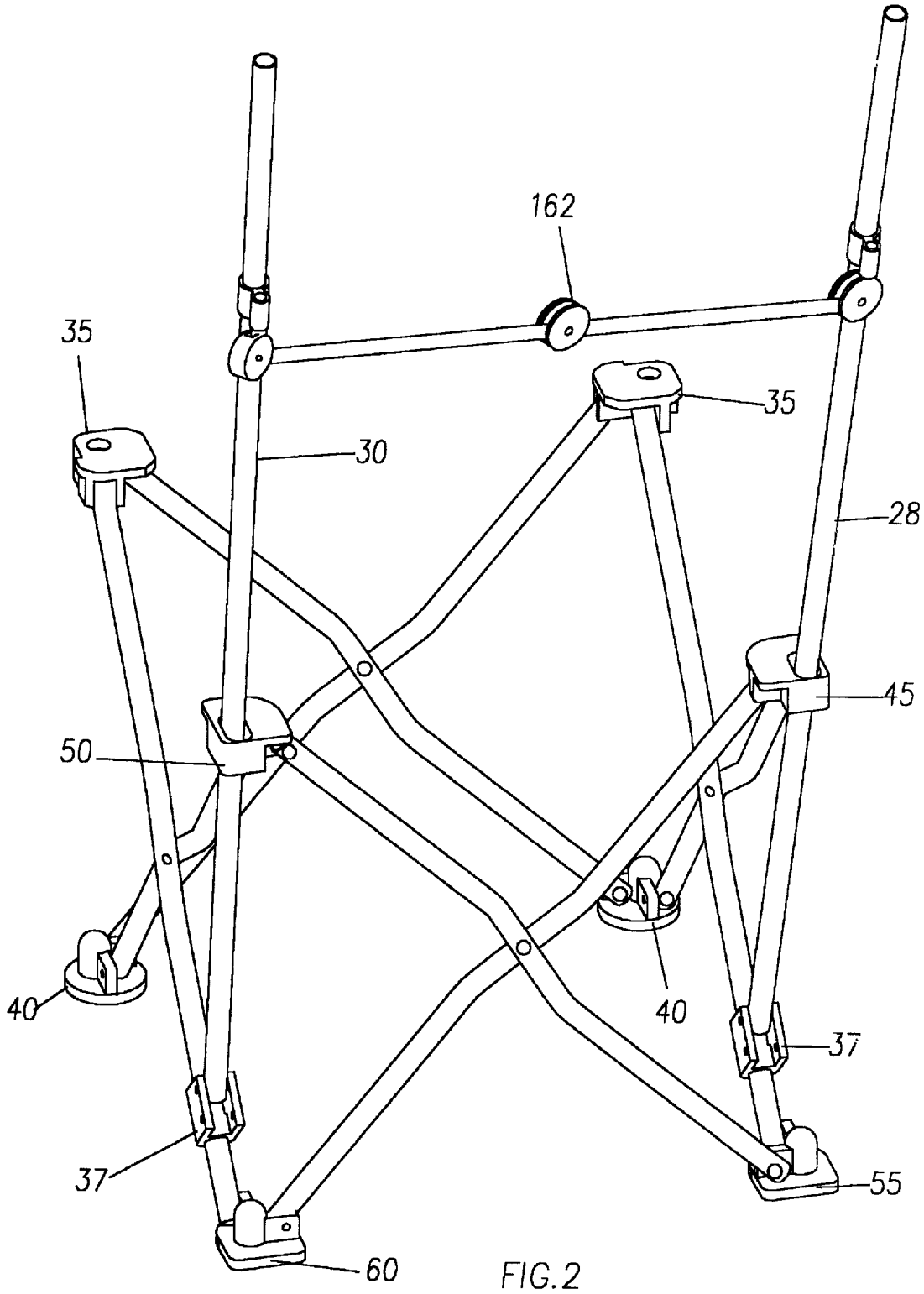
FIG. 2 is a rear perspective view of the reclining beach chair in its unfolded position.
Figure 3:
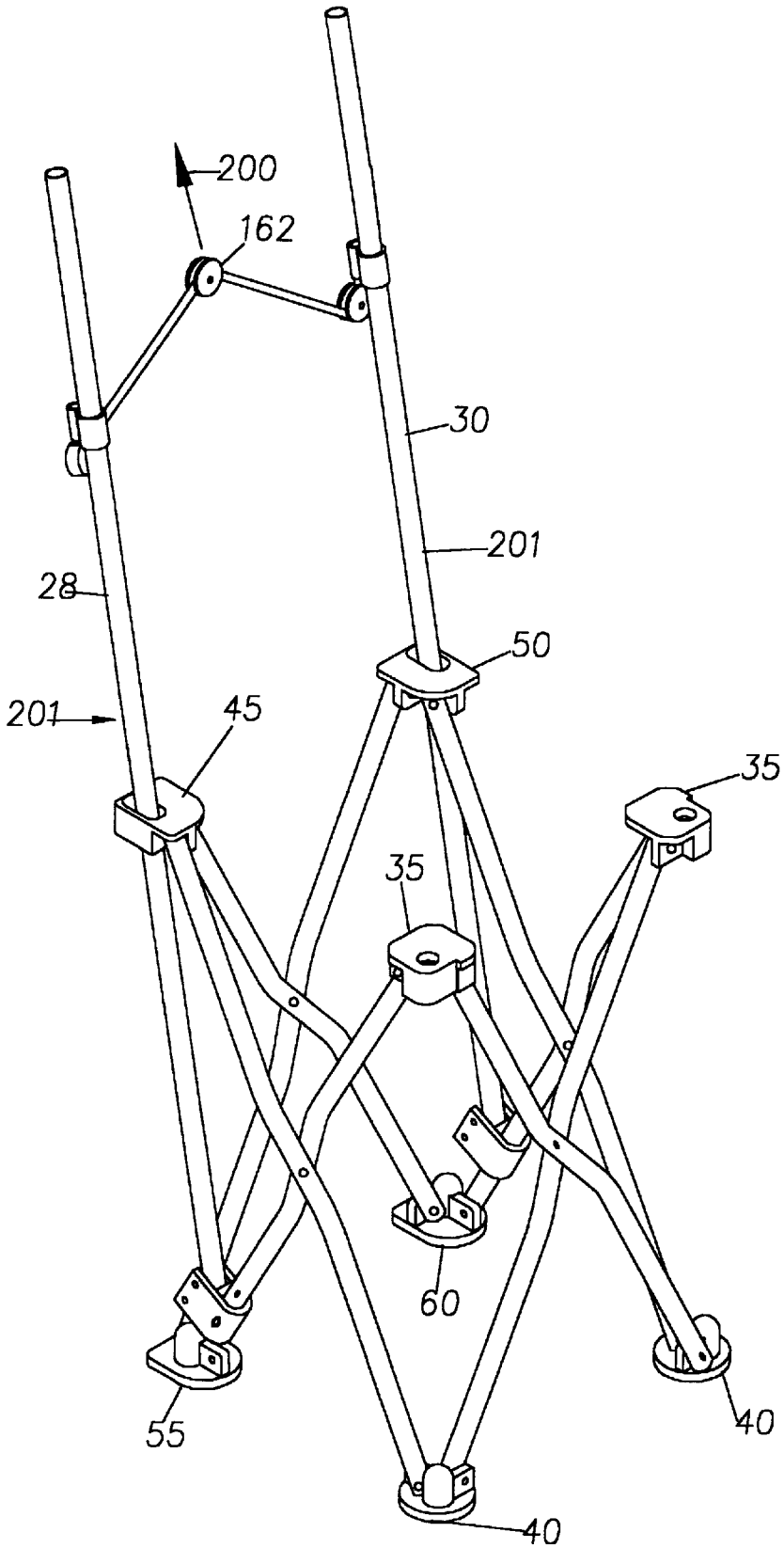
FIG. 3 is a front perspective view of the chair as it is being collapsed.
Figure 4:
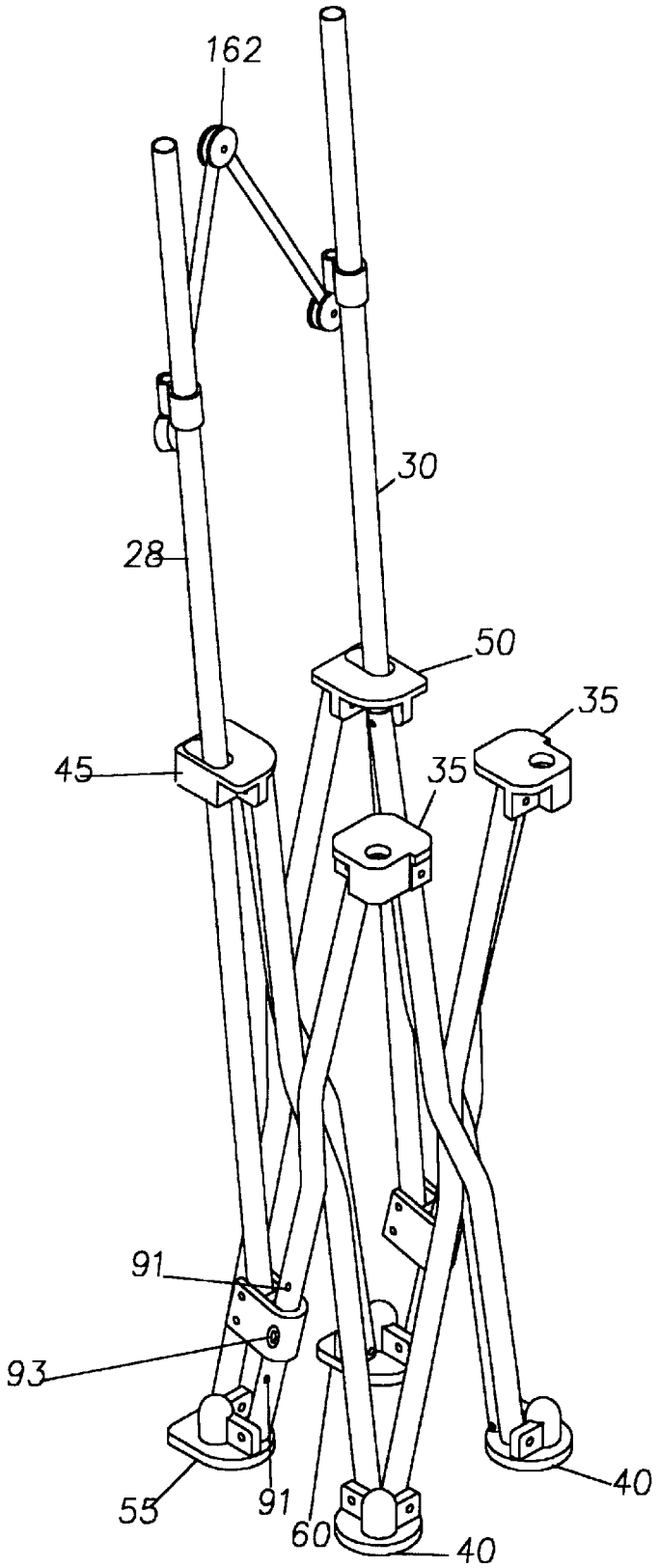
FIG. 4 is a front perspective view of the beach chair when fully collapsed, ready for storage.

A pair of front connectors 35 join the crossed legs 14 & 20 and 12 & 26 together at their upper ends. A pair of front pad connectors 40 join the crossed legs 12 & 22 together, as well as the crossed legs 14 & 24, at their bottom ends. Similarly, two rear connectors 45, 50 respectively connect the upper ends of crossed legs 16 & 22 and 18 & 24 at their upper ends. Two rear pad connectors 55, 60 respectively join the lower ends of the crossed legs 18 & 20 and 16 & 26. As shown in FIGS. 1–3, the side supports 28, 30 respectively extend downwardly through apertures 33, in the rear connectors 45, 50, to couple with a sliding lock mechanism 37 arranged to move linearly along the legs 20 and 26. As will be described below, the position of the lock mechanism along the legs 20, 26 sets the angle of recline of the chair frame 10, where it is positively secured in place.

Figure 17:
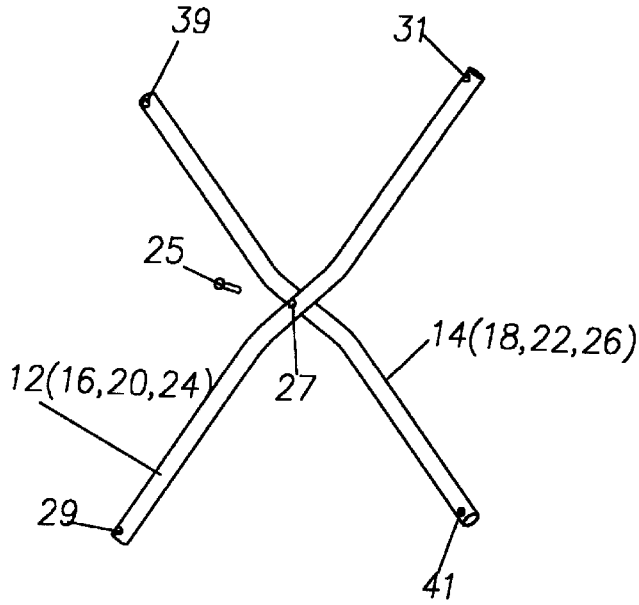
FIG. 17 pictorially illustrates a manner for securing the "X" shaped tubing legs together.
Figure 16A:
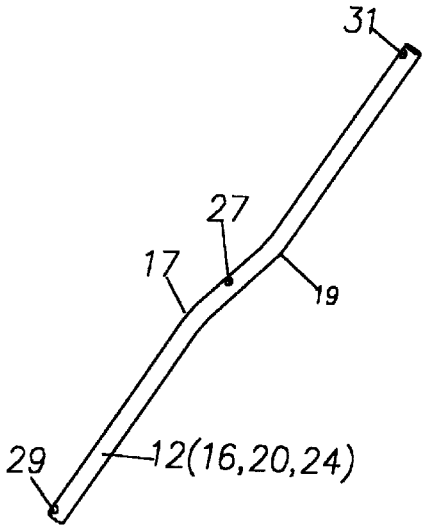
FIG. 16A and 16B pictorially illustrate two of the eight "X" shaped tubing legs of the reclining beach chair with the bends which allow for bringing its seat near to the ground, while allowing the chair to be eventually collapsed compactly.
Figure 16B:
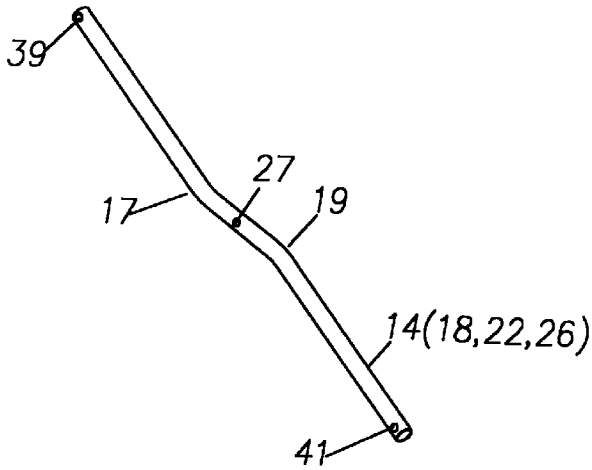

As illustrated in FIGS. 16A & 16B, the cross leg members 12 (also 16, 20, 24) and 14 (also 18, 22, 26) are fabricated with a pair of opposing "bends" at 17, 19 rather than being of "straight" length as are the legs of U.S. Pat. No. 5,984,406. An aperture 27 is provided mid-way between the bends 17, 19 to receive the pivot pin 25 (FIG. 17). Additional apertures 29, 31, 39 and 41 receive rivets or similar such fasteners in coupling the crossed legs 12 & 14, 16 & 18, 20 & 22 and 24 & 26 to the various connectors 35, 40, 45, 55 and 60 of FIG. 1.

In particular, the lower end 101 of the crossed legs 12 & 14 are fastened by rivet or other appropriate manner to the front wall 77 of the front pad connector 40 shown as having a perpendicular side wall 78 (FIG. 7A), the fastener passing through its aperture 79A. Similarly, the lower end 102 of the crossed legs 22 & 24 also are riveted, or otherwise fastened, to the perpendicular wall 78, by means of its aperture 79B. As illustrated, both front pad connectors 40 are identical, with one of the lower ends 101 being on one side of the front wall 77, the other lower end being on the opposite side, and with the two lower ends 102 being on opposing faces of the side wall 78.

Figure 9A:
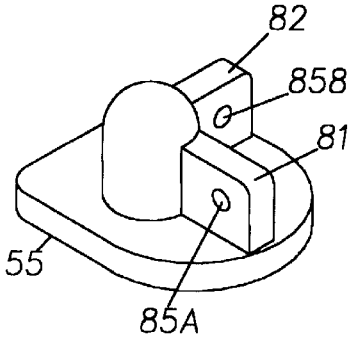
Figure 9B:
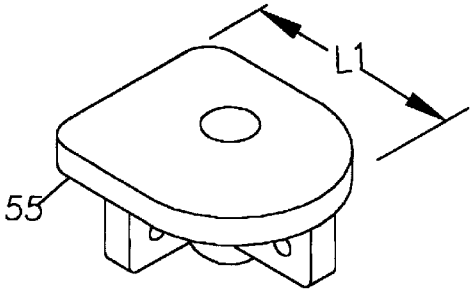
Figure 10A:
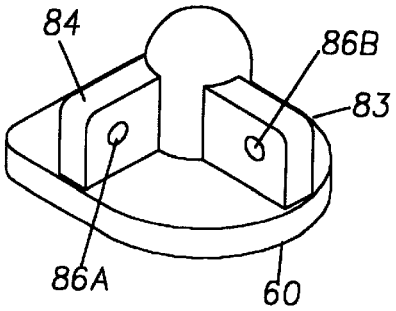
Figure 10B:
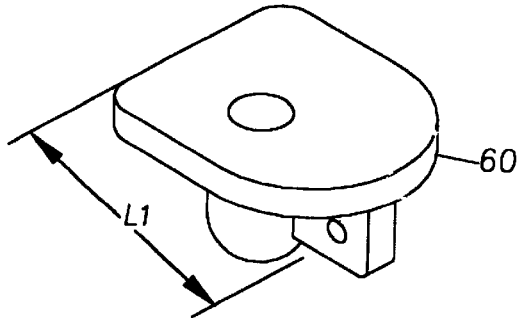
Figure 11A:
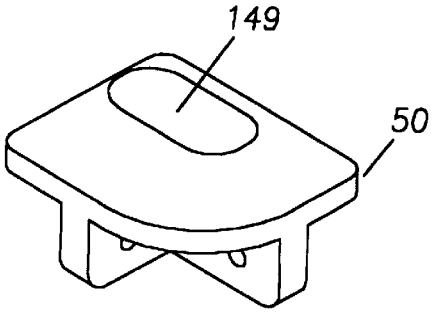
Figure 11B:
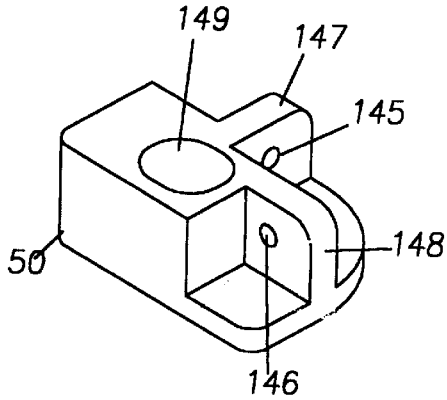
Figure 12A:
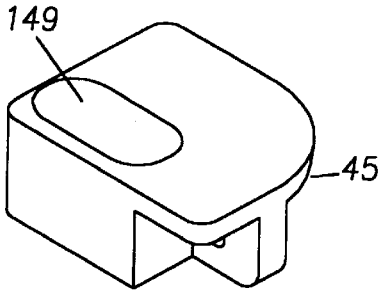
Figure 12B:
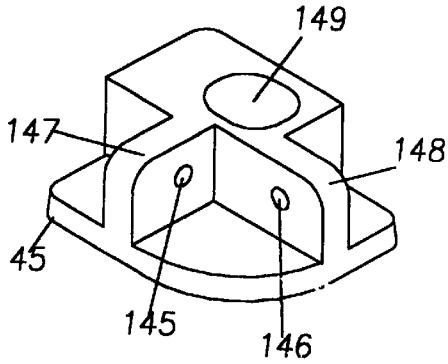

In like manner, the lower end 103 of the crossed legs 18 & 20 and the lower end 104 of the crossed legs 16 & 26 are fastened by rivets, or otherwise, to the rear pad connectors 55, 60 respectively, with the rear pad connector 55 being shown in FIGS. 9A & 9B, and with the rear pad connector 60 being shown in FIGS. 10A & 10B. Each of the connectors 55, 60 similarly include a pair of perpendicular walls 81, 82 and 83, 84, each with their own apertures 85A & 85B and 86A & 86B. As indicated, the lower end 103 of leg 20 is fastened to one side of the wall 81 via aperture 85A while the lower end 103 of leg 18 is fastened to one side of the wall 82 via aperture 85B. Correspondingly, the lower end 104 of leg 26 is fastened to the opposing surface of wall 83 of connector 60 via aperture 86B, while the lower end 104 of leg 16 is fastened to the opposing surface of wall 84 via aperture 86A.

Figure 8A:
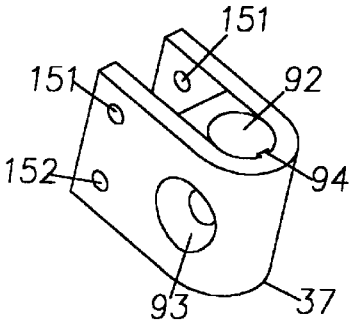
Figure 8B:
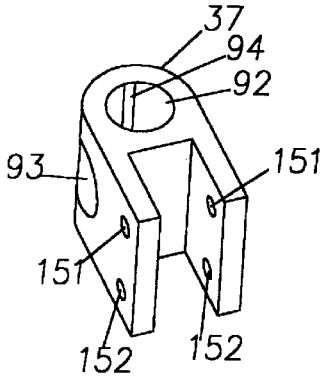

In accordance with the teachings of this reclining beach chair or lounger Application, the dimension $L_1$ (FIGS. 9B & 10B) between the front and rear surfaces of the connectors 55 and 60 is greater than the dimension $L_2$ (FIG. 7B) between the front and rear surfaces of the connector 40 (a diameter in the embodiment of FIGS. 7A & 7B) so as to effectively move the center of gravity of the frame 10 forward. This provides a greater stability to the reclining beach chair, a safety feature. Also to enhance stability and safety, a plurality of spaced, compressible pins 91 are included along the lower portion of legs 20 and 26 for fitting within the sliding lock mechanism 37 (FIGS. 8A and 8B). An aperture 92 in mechanism 37 receives the lower portion of the leg, with a second aperture 93 available to accept and capture the pin 91 by snap action to form a positive locking securement. A tab 94, of any desired cross-section, runs along the length of aperture 92 from front to back so as to slide within a linear groove 95 cut along the lower portion of legs 20 and 26 to secure and lock legs 20, 26 against sideways rotation—with the legs fabricated of extruded aluminum, which can be formed with the linear groove 95 as part of the extrusion. As will be appreciated, it is not generally an easy matter to make steel tubing with the groove 95 as required.

The upper end 111 of leg 20 and the upper end 113 of leg 14 are fastened together in front connector 35 in manner identical to the fastening in connector 32 of upper end 115 of leg 12 and upper end 117 of leg 26. The connectors 35 are illustrated in FIGS. 6A & 6B with one of the legs (20 or 12) being fastened through the apertures 121A and 121B of two parallel walls 122, 123, and with the other of the legs (14 or 26) being fastened through the aperture 124 of the perpendicular wall 125. The aperture 126 will be understood as receiving a screw or like fastener extending upwardly through the connector 35 to join with a cap 130 which holds the fabric liner 131 of the chair in place along the front of the seat (FIG. 5).

The upper end 141 of the leg 22 is similarly coupled with the upper end 142 of leg 16 within the connector 45, designed as a mirror image of the connector 50 which receives the upper end 143 of leg 18 and the upper end 144 of leg 24. These connectors 45 and 50 are illustrated in FIGS. 12A & 12B and 11A & 11B, respectively, with one leg fastened through each aperture 145, 146 of the perpendicular walls 147, 148, and with the aperture 149 corresponding to the aperture 33 in the connectors 45 and 50 of FIG. 1.

As illustrated in FIG. 1, to complete the basic frame 10 of the reclining beach chair or lounger, the side supports 28 and 30 pass through the aperture 33 in the connectors 45 and 50 to fasten by rivets or otherwise to the slide locking mechanism 37, and more particularly between the apertures 151—151 or 152—152—as illustrated in FIGS. 8A & 8B.

Figure 5:
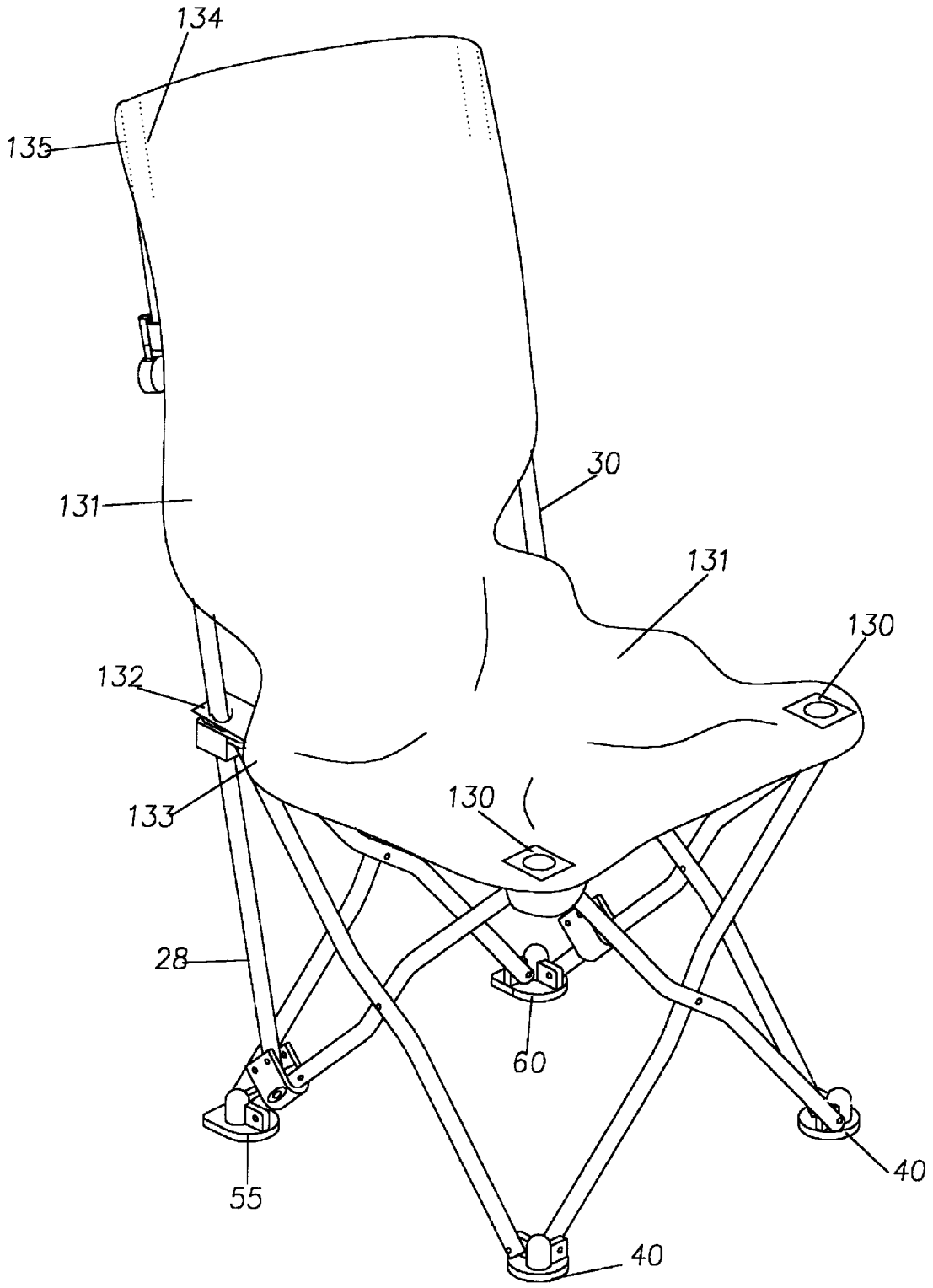
FIG. 5 is a front perspective view of the collapsible reelining beach chair or lounger in its unfolded position, with the seating fabric in place.
Figure 6A:
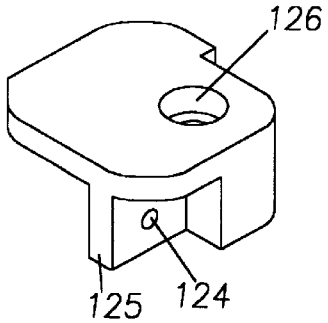
FIGS. 6A & 6B, 7A & 7B, 8A & 8B, 9A & 9B, 10A & 10B, 11A & 11B, 12A & 12B, 13A & 13B are top and bottom perspective views respectively of various component parts of the beach chair of such invention, which allow the chair to be opened, low to the ground when in use, and to be collapsed for storing away (in a duffle-type bag, for example) once the chair is fully collapsed.
Figure 6B:
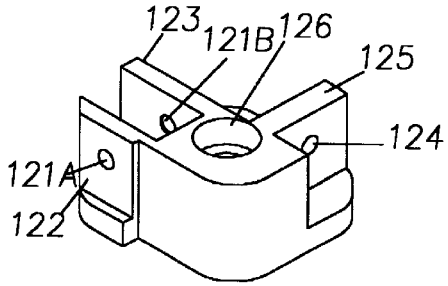
Figure 7A:
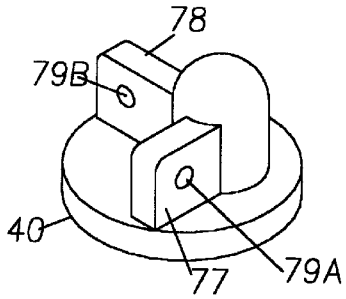
Figure 7B:
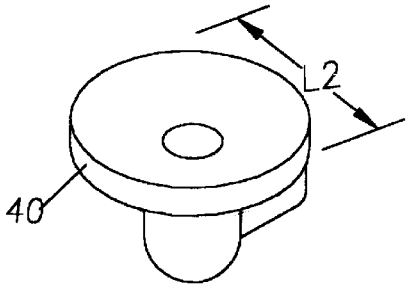

FIG. 5 illustrates the manner of attaching the fabric liner 131 to the chair frame 10. As previously mentioned, a cap 130 secures the front of the liner to the front of the frame. A strap 132 is sewn at left and right undersides 133 of the fabric liner 131, and is provided with an opening defined by a grommet (not shown), through which the side supports 28, 30 pass. A sleeve 134 is included at the rear underside of the fabric liner 131, to slip over the top 135 of the side supports 28, 30, reinforced in any desired manner. As shown, the strap 132 rests atop the rear connectors 45, 50.

With the frame 10 incorporating a pair of bends 17, 19 spaced about the pivot point 27, the seat level of the chair can be brought lower to the ground, to as low as six inches above it, as many users at a beach or seashore location (or just even on a backyard deck, or on the grass) prefer. By providing a slide locking mechanism 37 along the legs 20 and 26, the beach chair or lounger can be reclined to the desired angle, and with the snap provided through the multiple push pin positions with its capturing aperture 93, a secure lock at the desired position results. By making the rear pad connectors 55, 60 longer than the front pad connectors 40, further increased stability follows. With the position locking arrangements typifying the prior art, freeways rotational turning of the frame was experienced because of the "roundness" of the tubing employed in the lock—a possibility which is virtually eliminated through the scoring of the cross legs 20 and 26 at the groove 95, in receiving the tab 94 of the snap lock 37. In a preferred construction, the bends 17, 19 extend on either side of the pivot pins 25 a distance of 2 to 4 inches, depending upon how low to the ground the seat level of the frame 10 is to go. At the same time, the position to which the recline is set is adjustable either before or after the chair is opened.

Figure 13A:
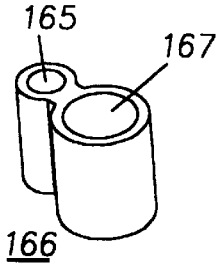
Figure 13B:
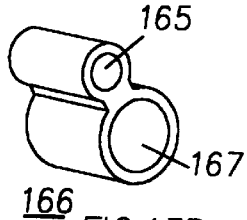
Figure 14A:
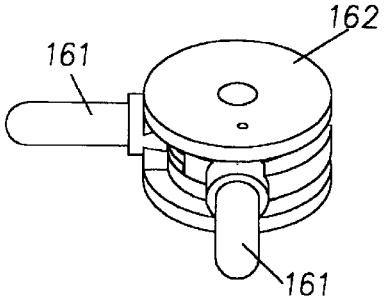
FIGS. 14A & 14B and 15A & 15B are top perspective views of components helpful in an understanding of the operation of the optional stabilizer bar of such reclining beach chair or lounger invention.
Figure 14B:
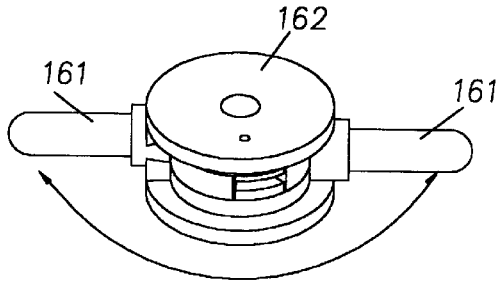
Figure 15A:
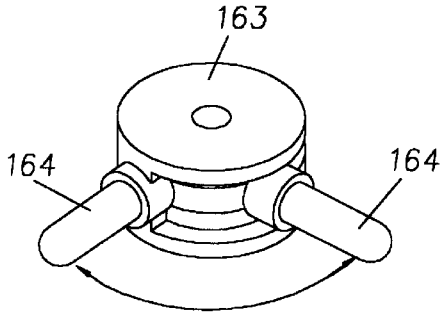
Figure 15B:
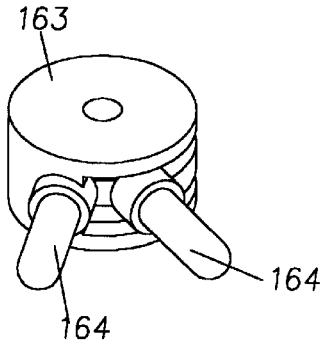

While the reclining beach chair or lounger as so far described performs quite well, a further feature of the design offers even greater stability in windy conditions, through the use of a bar 160 hinged between the supports 28, 30. Shown in FIG. 1, such bar 160 may be of a 2-piece tubular fabrication, fitted at one end "A" onto a rotatable extension 161 of a roller hinge 162 (FIGS. 14A & 14B showing the limits of rotation). At the opposite end "B" of the bar fabrication, a hinged bracket 163 is provided with its own rotatable extension 164 to fit within the tubular length (FIGS. 15A & 15B illustrating the rotational limits of this hinge). As shown in FIGS. 1, 13A and 13B, one rotatable extension 164 on each hinge 163 fits within an opening 165 in a coupler 166, a second opening 167 of which goes over the upper end 171 of the side supports 28, 30, where it is held by a press fit. When fabricating the bar 160 of aluminum or other stiffening material, not only is back support provided for the fabric of the chair, but stability of the side supports 28, 30 is present against ensuing wind.

FIG. 3 illustrates the first step in collapsing the reclining beach chair after use, where the stabilizer bar 160 is employed. Namely, the roller hinge 162 is lifted upwardly, as shown by the arrow 200, which exerts a pressure on the side supports 28, 30, in the direction of the arrows 201 pulling the supports toward each other. The motion rotates the locking mechanisms and the various legs and connectors inwardly, to take on the compact configuration of FIG. 4. Such action raises the rear connectors 45 and 50, to lift the fabric liner 131 which rests thereon, to collapse it as well, wherein the beach chair or lounger, then in a collapsed condition, can be placed in a duffle bag and carried about, or otherwise stored. Where the stabilizer bar 160 is not employed, only a gentle pressure on the supports 28, 30 in the direction of the arrows 201 is all that is necessary to begin the collapsing action.

As my application Ser. No. 09/551,664, U.S. Pat. No. 6,179,374 describes, whereas compressible pins 91 are set out to snap the slide lock mechanism 37 in secured position, other manners of fastening the mechanism in place can be utilized instead—such as by a lever and actuating spring into the extruded tubing.

B. Ser. No. 09/561,339, U.S. Pat. No. 6,322,138, Collapsible Patio Chair

As with the folding chair of U.S. Pat. No. 5,984,406, the collapsible patio chair of the application Ser. No. 09/561,339, U.S. Pat. No. 6,322,138 invention is also constructed out of tubular members. In FIG. 18, the frame of the patio chair 210 includes eight crossed legs in pairs of two each—front legs 212, 214, rear legs 216, 218, and side legs 220, 222 and 224, 226. As illustrated, each of the pairs 212 & 214, 216 & 218, 220 & 222 and 224 & 226 are joined together by pivot pins 225. The frame 210, furthermore, includes a pair of side supports 228, 230—which, like the crossed legs 212 & 214, 216 & 218, 220 & 222 and 224 & 226 are tubular, and are constructed of aluminum or steel.

A pair of front connectors 235 join the crossed legs 214 & 220 and 212 & 226 together at their upper ends. A pair of front pad connectors 240 join the crossed legs 212 & 222 together, as well as the crossed legs 214 & 224, at their bottom ends. Similarly, two rear connectors 245, 250 respectively connect the upper ends of crossed legs 216 & 222 and 218 & 224 at their upper ends. Two rear pad connectors 255, 260 respectively join the lower ends of the crossed legs 218 & 220 and 216 & 226. As shown in FIGS. 18–20, the side supports 228, 230 respectively extend downwardly through apertures 233, in the rear connectors 245, 250, to fix with the rear pad connectors 255 and 260 without pivoting. With the patio chair constructed with hand rests, each front leg 212, 214 is provided with an extension 265 that extends upwardly through the front connectors 235 and bends outwardly to form a front support 266 where it is secured, as by a screw, with a sleeve at a front underside of a fabric hand rest (215, in FIG. 21), at the rear of which a grommet 267 on the fabric encircles the side supports 228, 230, and where it is restricted in upwards movement by a ring 268 on the supports 228, 230. As with the hand rests of U.S. Pat. No. 5,984,406, the hand rest 215 provides a support for the user's arm, as well as a manner to fold and unfold the chair with adequate leverage.

Particularly referring to FIGS. 18, 19, 24A & 24B, and 25A & 25B, the lower end 301 of the crossed legs 212 & 214 are fastened by rivet or other pivot manner to the front wall 284 of the front pad connector 240 shown as having a generally perpendicular side wall 283, the fastener passing through its aperture 286A. Similarly, the lower end 302 of the crossed legs 222 & 224 is also fastened by rivet, or other pivot to the wall 283, by means of its aperture 286B. As illustrated, both front pad connectors 240 are identical, with one of the lower ends 301 being pivoted on one surface of the front wall 284, with the other one of the lower ends 301 being on the opposite surface of the front wall 284, and with the two lower ends 302 being pivoted on opposing faces of the side wall 283.

In like manner, the lower end 303 of the crossed legs 218 & 220 and the lower end 304 of the crossed legs 216 & 226 are fastened by rivets, or other pivots to the rear pad connectors 255, 260 respectively, with the rear pad connector 255 being of the configuration shown in FIGS. 25A & 25B, and with the rear pad connector 260 being of the configuration shown in FIGS. 25A & 25B rotated 90° counterclockwise. Each of the connectors 255, 260 thus include their own pairs of generally perpendicular walls and their own apertures. As indicated, the lower end 303 of leg 220 is fastened by pivot or otherwise to rear pad connector 255 at one surface of the wall 284 via aperture 286A while the lower end 303 of leg 218 is fastened by pivot or otherwise to one surface of the wall 283 via aperture 286B. Correspondingly, the lower end 304 of leg 226 is fastened to the opposing surface of wall 284 of connector 260 via aperture 286A, while the lower end 304 of leg 216 is fastened to the opposing surface of wall 283 via aperture 286B. In accordance with the invention, apertures 287 are included at the joins 288 of the walls 283, 284 of the connectors 255, 260 to receive the lower ends of the side supports 228, 230, where they are fixed by rivets or otherwise, without pivoting. Although not receiving side supports, the front pad connectors 240 may be constructed with a similar aperture 287 at the joins 288 of their walls 283, 284, to allow for a common construction of these front and rear pad connectors and an interchangeability of components, although such apertures 287 at the front pad connectors are not needed for operation of the collapsible patio chair.

The upper end 311 of leg 220 and the upper end 313 of leg 214 are fastened together in front connector 235 in manner identical to the fastening in connector 35 of upper end 315 of leg 212 and upper end 317 of leg 226. The connectors 235 are illustrated in FIGS. 22A & 22B and 23A & 23B—with the configurations of FIG. 22A & 22B receiving the legs 212 and 226, and with the configuration of FIGS. 23A and 23B receiving the legs 214 and 220. As shown, the connectors 235 include a top surface 290 having a notch therein 291 open at one end, understood to be slightly larger than the diameter of the crossed legs 212, 214 when composed as a tubular configuration. This dimensioning allows the legs 212, 214 to glide easily within the notch 291 as the patio chair is folded closed or opened. As more particularly shown in FIGS. 22B and 23B, the front connectors 235 further include a first wall 292 at an underside defining one side of the notch 291 and to which the legs 214 and 212 are fastened. At the same time, the connectors 235 include a second wall 293 at the underside, generally perpendicular to the wall 292 in combination therewith, to which the upper ends 311 and 317 of the crossed legs 220 and 226 are fastened. In similar manner, both perpendicular walls 292, 293 are provided with apertures 295, 296 for fastening with their respective pivotally connected legs.

The upper end 341 of the leg 222 is similarly coupled with the upper end 342 of leg 216 within the connector 245, designed as a mirror image of the connector 250 which receives the upper end 343 of leg 218 and the upper end 344 of leg 224. These connectors 245 and 250 are illustrated in FIGS. 26A & 26B and 27A & 27B respectively, with one leg fastened through each aperture 345 and 346 of the perpendicular walls 347 and 348 as shown, and with the aperture 349 corresponding to the aperture 233 in the connectors 245 and 250 of FIG. 18 through which the side supports 228, 230 pass.

FIG. 21 illustrates the manner of attaching the fabric liner 331 to the chair frame 210. A sleeve at an underside of the liner front 332 is pulled down once installed at A to fit over the front connectors 235. A strap 333 is sewn at left and right undersides 334 of the fabric liner 331, and is provided with an opening defined by a grommet 335 through which the side supports 228, 230 pass. As shown, the strap 333 rests atop the rear connectors 245, 250, and its upward movement is restricted by a second ring 269 on the side supports 228, 230. Sleeves are also included at the rear underside of the fabric liner 331, adjacent its top, to slip over the top 336 of the supports 228, 230 (where they are secured as by a screw), with all areas of connection of the fabric liner being reinforced in any desired manner.

To collapse the opened chair of FIG. 18, all that is needed is for one to grasp onto the upper bends 265 of the legs 212, 214, and push them towards one another. The legs 212, 214 readily slide within the notch 291, and the pivot connections of all the legs to opposing faces of the perpendicular walls reliably collapses the frame 210 to the compact configuration of FIG. 20. Then, in a collapsed condition, the patio chair can be placed in a duffle bag and carried out, or otherwise stored. As will be appreciated, the collapsing of the chair to the configuration of FIG. 20 will be understood to fold the fabric hand rest 215 upwardly and out of the way at the same time.

C. Ser. No. 09/593,938, Collapsible Cot

As with the folding chair of U.S. Pat. No. 5,984,406, the collapsible cot of the application Ser. No. 09/593,938, invention is further constructed out of tubular members. In FIG. 28, the frame of the cot 410 includes a first pair of front crossed legs 412, 414, a second pair of front crossed legs 416, 418, a first pair of rear crossed legs 420, 422, a second pair of rear crossed legs 424, 426, a first pair of side crossed legs 428, 430, a second pair of side crossed legs 432, 434, and a third pair of side crossed legs 436, 438. As illustrated, each of the pairs 412 & 414, 416 & 418, 420 & 422, 424 & 426, 428 & 430, 432 & 434, and 436 & 438 are joined together by pivot pins 425.

A first front pad connector 440 pivotally connects to lower ends of the front crossed leg 412 and the side crossed leg 428, while a second front pad connector 442 pivotally connects to lower ends of the front crossed leg 418 and the side crossed leg 432. A first rear pad connector 444 pivotally connects to the lower ends of the rear crossed leg 420 and the side crossed leg 430, while a second rear pad connector 446 pivotally connects to lower ends of the rear crossed leg 426 and the side crossed leg 434. A first front connector 448 pivotally connects to the upper ends of the front crossed leg 414 and the side crossed leg 430 while a second front connector 450 pivotally connects at an upper length of the front crossed leg 416 and to the upper end of the side crossed leg 434. A first rear connector 452 pivotally connects to the upper ends of the rear crossed leg 422 and the side crossed leg 428, while a second rear connector 454 pivotally connects at an upper length of the rear crossed leg 424 and to the upper end of the side crossed leg 432.

In accordance with the construction of the collapsible cot, a third front pad connector 456 is included, pivotally connected to the lower ends of the front crossed legs 414 & 416 and to the lower end of the side crossed leg 436. A third rear pad connector 458 similarly is pivotally connected to the lower ends of the rear crossed legs 422 & 424, and to the lower end of the side crossed leg 438. A third front connector 460 pivotally connects to upper ends of the front crossed legs 412 & 418, and to the upper end of the side crossed leg 438. A third rear connector 462 then pivotally connects to the upper ends of the rear crossed legs 420 & 426, and to the upper end of the side crossed leg 436.

To complete the configuration of the frame 410, a first side extender 470 pivotally couples to the front crossed leg 416 along its upper length, while a second side extender 472 pivotally couples to the rear crossed leg 424 along its respective own upper length.

As illustrated in FIG. 37, a fabric liner 500 is connected to the front connectors 448 and 460 and to the rear connectors 452 and 462 and to fit over and around the upper ends A, B, of the side extenders 470, 472—both for this construction of the cot and for a second construction to be described below.

In FIG. 28, the side extenders 470, 472 are shown pivotally coupled to the front crossed leg 416 and to the rear crossed leg 424 at a point above the second front connector 450 and the second rear connector 454, respectively. FIGS. 29A–29F illustrate the pivotal coupling of the two side extenders 470, 472 to their respective front and rear crossed legs 416, 424 by means of a hinge pin 490, 492, for example, in the manner noted in FIGS. 29A–29C, and rotatable from its open position of FIG. 29D through its immediate position shown in FIG. 29E to its folded position of FIG. 29F, when it is desired to collapse the frame 410 of the cot. The end of the extenders 470, 472 to which the fabric liner 500 secures when in place is again indicated at A, B. FIGS. 38A–38C in this respect illustrate sectional views of a manner of securing the fabric liner 500 to the front connectors 448, 460 and to the rear connectors 452, 462, by means of a bolt 501, for example, extending through apertures 575 in the liner 500 overlying each of the four connectors at such point, to seat within a cap 502 which fits substantially flat there against the top surface of the liner 500.

FIG. 35, on the other hand, shows an alternative construction in which the side extenders 470, 472 are each pivotally coupled to the front crossed leg 416 and to the rear crossed leg 424 at a point below the second front connector 450 and below the second rear connector 454, respectively, instead of above those connectors as in FIG. 28. As shown in FIGS. 36A and 36B, the construction of FIG. 35 is one in which a first bracket 484 is included at a point below the second front connector 450 while a similar second bracket 486 is included at a point below the second rear connector 454. As illustrated more particularly in FIG. 36B, the two side extenders (470 on the one hand, and 472 on the other), are pivotally coupled to the brackets 484, 486, by a pin 435 to permit the pivoting of the side extenders 470, 472, about both the front crossed leg 416 and the rear crossed leg 424. Each of the brackets 484, 486 typically may be composed of steel, welded to the crossed leg 416 (or 424 as the case may be), to receive and join with the respective extender 470, 472. As FIGS. 36A and 36B further show, a first tap 480 is provided along the upper length of the front crossed leg 416 while a second such tap 482 is provided along the upper length of the rear crossed leg 424, to allow for positioning of the side extenders 470 and 472, respectively, in fixing the position of the side extender with its respective crossed leg.

FIG. 36B further shows a fastener 488 at left and right undersides of the fabric 500, near its top end, at a position to overlie the side extender and its adjacent crossed leg, for securing the respective extender and leg together. Thus, those points labelled C and D in FIG. 35 illustrate the locations where the fasteners 488 of the fabric 500 secure in holding the side extender 470 to the crossed leg 416 and the side extender 472 to the crossed leg 424—with the fastener 488 being in the form of a steel ring when the crossed legs 416, 424 and the side extenders 470, 472 are tubular. FIG. 37, in this respect, shows this alternative construction with the fabric liner 500.

Particularly referring to FIGS. 28, 35, 37, 30A & 30B, the lower end of the front crossed legs 412 & 418 are fastened by rivet or other pivot manner to the front wall 510 of the front pad connectors 440, 442, shown as having a generally perpendicular side wall 512, the fastener passing through its aperture 514. Similarly, the lower end of the side crossed legs 428 & 432 is also fastened by rivet or other pivot to the wall 512 by means of its aperture 516. As illustrated, both front pad connectors 440, 442 are identical, with the lower end of the front crossed leg 412 being pivoted on one surface of the front wall 510 on one connector 440, 442, with the lower end of the front crossed leg 18 being on the opposite surface of the front wall 510 of the other connector 440, 442, and with the lower ends of the side crossed legs 428 and 432 being pivoted on opposing faces of the side wall 512.

In like manner, referring to FIGS. 28, 35, 37, 32A & 32B, the lower end of the rear crossed legs 420 & 426 and the lower ends of the side crossed legs 430 & 434 are fastened by rivets or other pivots to the rear pad connectors 444, 446. Each of the connectors 444, 446 include their own pairs of generally perpendicular walls and their own apertures. Thus, and as indicated, the lower end of the front crossed leg 420 is fastened by pivot or otherwise to rear pad connector 444 at one surface of the wall 511 by aperture 515 while the lower end of leg 426 is fastened by pivot or otherwise to one surface of the wall 513 by aperture 517. Correspondingly, the lower end of the side crossed leg 430 is fastened to the opposing surface of wall 511 via aperture 515 while the lower end of the side crossed leg 434 is fastened to the opposing surface of wall 513 via aperture 517. In accordance with the construction, an aperture 518 is included at the joins of the walls 511 & 513 of the connectors 444, 446 to receive the lower end of the rear supports 464, 466, where they are fixed by rivets or otherwise, without pivoting. Although not receiving any supports, the front pad connectors 440, 442 may be constructed with a similar aperture 519 at the join of their walls 510 & 512, to allow for a common construction of these front and rear pad connectors and an interchangeability of components, although such apertures 519 at the front pad connectors 440, 442 are not needed for the operation of the collapsible cot.

As an examination of FIGS. 28 and 37 will show, the front connector 448 may be constructed identical to the rear connector 452, except insofar as the rear connector 452 includes an aperture to receive the upper end of the rear support 464—with the remaining structure of these two connectors continuing to have generally perpendicular side walls to which the upper ends of the front crossed leg 414 and the side crossed leg 430 are pivoted on the one hand with respect to the front connector 448, and to which the upper ends of the rear crossed leg 422 and the side crossed leg 428 are likewise pivotally connected with respect to the rear connector 452 on the other hand, This is shown in FIGS. 34A & 34B where the perpendicular side walls are shown at 547, 548, and where the aperture for the support 464 is shown at 549. The pivot connections for the legs are through the apertures 545, 546.

The third front pad connector 456 is similarly constructed comparable to the third front connector 460 in having yet a further perpendicular wall so as to receive three sets of legs instead of the two sets as with the front pad connectors 440 and 442—pivotally receiving the lower ends of the front crossed legs 414 & 416 and the lower end of the side crossed leg 436. Correspondingly, the third front connector 460 receives at its three perpendicular walls, the pivot connections of the front crossed legs 412 & 418 and the upper end of the side crossed leg 438. The third rear connector 462, on the other hand, includes the same three perpendicular walls to receive, in pivot connections, the upper ends of the rear crossed legs 420 & 426 and the side crossed leg 436—although with a further aperture to receive the rear support 468 extending up from the rear pad connector 458. In such manner, the rear pad connector 458 and the rear connector 462 may be mirror images of one another, just as are the front pad connector 456 and the front connector 460. As will be appreciated, each of the connectors 448, 452, 460 and 462 are provided with apertures 475 as indicated in FIGS. 28 and 35 to receive the bolt 501 and cap 502 of FIGS. 38A, 38B & 38C in holding the fabric liner 500 in place.

To complete the constructions of the collapsible cot, the upper end of the side crossed leg 432, is fastened along the upper length of the rear crossed leg 424 on the rear connector 454 in a manner identical to that by which the upper end of the side crossed leg 434 is fastened along the upper length of the front crossed leg 416 in the front connector 450. Such connectors 450 and 454 are illustrated in FIGS. 31A & 31B and 33A & 33B, respectively—with the configurations of FIGS. 31A and 31B receiving the legs 416 and 434, and with the configurations of FIGS. 33A & 33B receiving the legs 424 and 432. As shown, the connectors 450, 454 include a top surface 550 having a notch therein 551 open at one end, understood to be slightly larger than the diameter of the crossed legs 416, 424 when composed as a tubular configuration. This dimensioning allows the legs 416, 424 to glide easily within the notch 551 as the cot is folded closed or opened. As more particularly shown in FIGS. 31B and 33B, the front connector 450 and the rear connector 454 further include a first wall 552 at an underside defining one side of the notch 551 and to which the legs 416 and 424 are fastened. At the same time, the connectors 450 and 454 include a second wall 553 at the underside, generally perpendicular to the wall 552 in combination therewith, to which the upper ends of the side crossed legs 434 and 432 are fastened. In similar manner, both perpendicular walls 552 and 553 are provided with apertures 554, 555 for fastening with their respective pivotally connected legs.

To collapse the opened cot of FIGS. 28 and 35, all that is needed is for one to push forward the side extenders 470, 472, to the upper ends of the front crossed leg 416 and the rear crossed leg 424. The legs 416, 424 readily slide within the notch 551, and the pivot connections of all the legs to opposing faces of the perpendicular walls reliably collapses the frame to a compact configuration. Then, in a collapsed condition, the cot can be simply carried to wherever it may be placed for storage. As will be appreciated, the collapsing of the cot will be understood to fold the fabric liner 500 inwardly and out of the way at the same time,yet without it having to be removed from the side extenders 470, 472.

D. Collapsible Sunshade of the Present Invention

As with the collapsible reclining beach chair or lounger, as with the collapsible patio chair, and as with the collapsible cot, the collapsible sunshade of the invention is also constructed out of tubular members. In FIG. 39, the sunshade includes a canopy 600 having first and second arms 602, 604, first and second elbows 606, 608, and first and second posts 610, 612, with each of the posts 610, 612 being individually coupled at their upper ends to the first and second elbows 606, 608, respectively. A pair of supports 614, 616 are also coupled to the first and second elbows 606, 608—which, as shown in FIGS. 42A–42C and FIGS. 43A–43C are generally of T-shape, with crosspieces 618 and 619 being secured to one end of the supports 614 & 616 by a rivet or pin 630 & 631, respectively, and with columna 620 and 621 being secured to one end of the posts 610 & 612 by a rivet or pin 632 & 633, respectively. As illustrated in FIGS. 42B–42C and 43B–43C, each elbow 606, 608 includes a push pin 622 biased inwardly by a spring 624 to be moved against the bias by thumb pressure applied to its lever 626. Although not shown as such, it will be understood that the end of the support 614, 616 adjacent to the elbow 606, 608 is provided with an aperture through which the pin 622 may fit when thumb pressure is released (FIGS. 42B, 43B), and which is freed therefrom when thumb pressure is applied (FIGS. 42C, 43C).

In accordance with a preferred embodiment of the invention, securement of the push pin 622 in such aperture orients the supports 614, 616 (as shown in FIG. 39) in a substantially horizontal position. Actuating the thumb press lever 626 to release the pin 622 from such aperture allows the supports 614, 616 to be lowered in a clockwise direction shown by the arrow A, to be locked against upward rotation upon release of the thumb pressure by the resulting bearing surface of the pin 622 against the top of the supports 614, 616. In such manner, any tendency for wind gusts to raise the sunshade once in position in the direction shown by the arrow B is prevented—either by the locking of the pin 622 in the aperture, or by the pin 622 bearing against the top of the support.

Figure 40A:
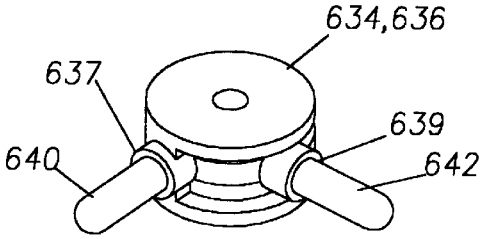
Figure 40B:
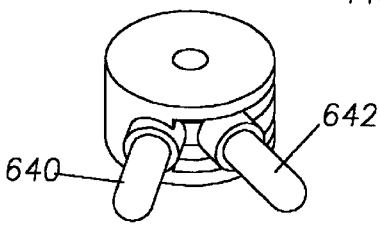
Figure 40C:
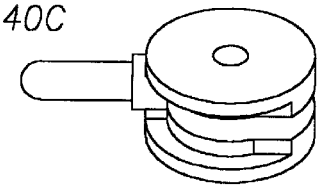
Figure 40D:
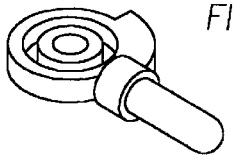

The collapsible sunshade of FIG. 39 further includes first, second and third pivot hinges 634, 636 and 638. Shown in FIGS. 40A–40D, the pivot hinges 634 and 636 each include a pair of extensions 640, 642, with one being fixed (640) and with the other (642) being rotatable from an angle of 30° or so (FIG. 40B) to an angle of 90 (FIG. 40A). With FIGS. 40C and 40D being sectional detail views of the hinges 634 and 636 (at 637 and 639, respectively), it will be understood that the perspective view of FIG. 39 is one where the hinges 634 and 636 are in the position shown in FIG. 40A, and where the arms 602 and 604 are to be thereafter collapsed as described below, until the position of FIG. 40B is taken on by the pivot hinges 634, 636.

Figure 41A:
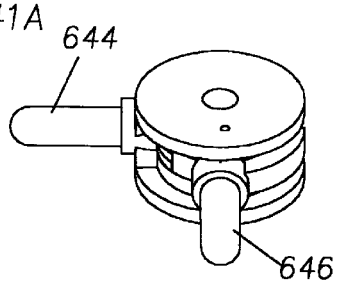
Figure 41B:
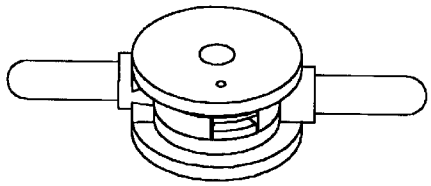
Figure 41C:
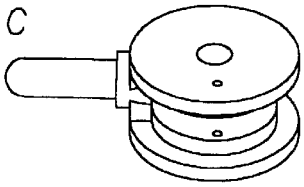
Figure 41D:
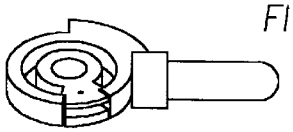

The third pivot hinge 638, on the other hand, has its pair of extensions 644, 646 arranged to spread 180° when fully opened, as shown in FIG. 41B and as represented in the perspective view of FIG. 39 opening the arms 602, 604. The views of FIGS. 41C and 41D, in this respect, are sectional detailed views of the hinge 638 (at 644 and 646, respectively), with FIG. 41A showing the extensions 644 and 646 at substantially 90° apart when the arms 602, 604 are folded. As will be appreciated, the dimensions selected for the tubular supports 614 and 616, and for the tubular arms 602, 604 are such as to accept the extensions 640, 642, 644 and 646 as the case may be, in a "press fit", for example. Pushing in upon the pivot hinge 638 in the direction of the arrow C then causes the arms 602, 604 to rotate inwardly, thereby aligning the arm 602 towards the support 614 and the arm 604 towards the support 616, thereby collapsing the canopy 600. Conversely, pulling the pivot hinge 638 rotates the arms 602, 604 outwardly, to open the canopy 600. As with the extension 640 of pivot hinges 634, 636, the extension 644 of pivot hinge 638 is fixed.

In accordance with the teachings of the present invention, the canopy of FIGS. 39–43 is to be coupled in forming a sunshade with each of the collapsible reclining beach chair or lounger of FIG. 1, with the collapsible patio chair of FIG. 18 and with the collapsible cot of FIG. 28. To address this for the reclining beach chair or lounger, a modification is first made in the coupler 166 as shown in FIGS. 13A and 13B. In particular, a third opening is added, as shown by the coupler 666 in FIG. 44, so that its opening 655 receives the rotatable extension 164 on the hinged bracket 163, its second opening 657 goes over the upper end 171 of the side supports 28, 30, and its third opening 659 is provided to receive the lower end of the posts 610, 612, and to be held by glue or rivet. The resulting lounger is as then shown in FIG. 45.

A similar such coupler 666 is employed for using the canopy of FIG. 39 with the collapsible patio chair of FIG. 18, as shown in FIG. 46. The coupler opening 657 receives the side supports 228, 230, while the opening 655 receives the canopy posts 610, 612 riveted together. The third opening 659 acts as a spacer to allow for the bend at the upper end of the side supports 228, 230. In the constructions of FIGS. 45 and 46, the length of the post 610, 612 may be of the order of some 3 feet—and is preferably fitted within another tube 677 coupled with the rear connectors 245 and 250 of the patio chair for added stability (FIG. 46), as a detachable sunshade. In an alternative construction, on the other hand (not shown), the tubes 677 could be fabricated as a straight piece, extending down into the illustrated aperture at the back of the rear pad connectors, to receive the posts 610, 612 in telescoping, non-detachable manner, to collapse inwardly or extend outwardly as the case may be.

Figure 42A:
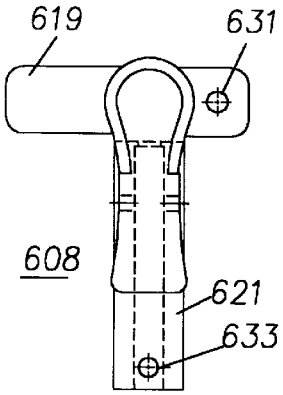
Figure 42B:
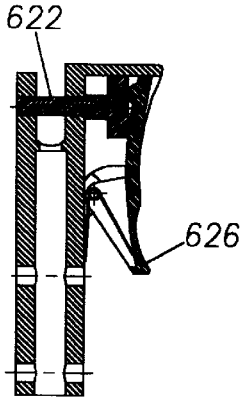
Figure 42C:
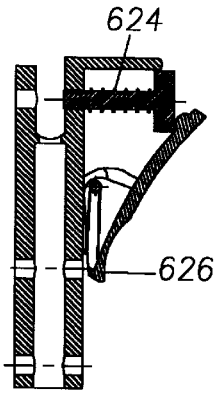
Figure 43A:
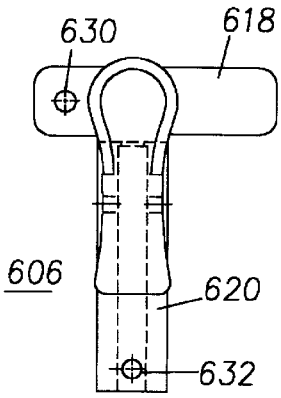
Figure 43B:
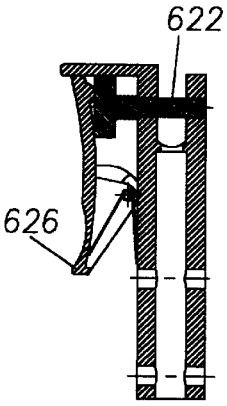
Figure 43C:
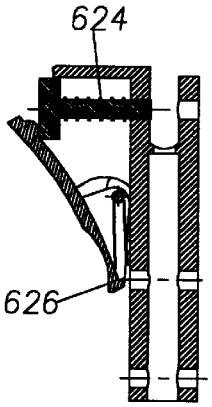

In operation, a user sitting upright in the patio chair (FIG. 47, with the chair fabric 679 and the canopy fabric covering 681 in place, but with the component hardware removed for simplicity) can retain the sunshade 683 in a horizontal position (i.e. with the push pin 622 of FIG. 42B, 43B fitted within the aperture at the end of the support 614, 616 adjacent the elbow 606, 608, or can rotate the sunshade 683 downwardly in the direction of the arrow A in FIG. 45 to a lower position by freeing the push pin 622 and releasing it so that it bears against the upper surface of the supports 614, 616 after adjustment. With the reclining beach chair or lounger of FIG. 39, on the other hand, when a user tilts back on the recliner, retaining the sunshade 683 with the push pin 622 in the aperture of the support 614, 616 effectively angles the sunshade upwardly to give a greater angle of view. Lowering the supports 614, 616 beneath the push pin 622 then restores the sunshade 683 to the horizontal position even were the lounger to be tilted back. In either event, the push pin 622 continues to prevent the sunshade 683 from blowing upwardly on the wind gusts through its locking arrangement within the aperture of the support 614, 616, or through its bearing against the upper surface of the support when lowered.

A similar coupling of the sunshade of the invention to the cot of the application Ser. No. 09/593,938, U.S. Pat. No. 5,984,406 can be had—but, in the arrangements of FIG. 48 (without its seating fabric) and FIG. 49 (with its seating fabric 687 in place), the canopy 691 first of all includes a third elbow 670, a third post 672, a third support 674, two additional arms 676, 678, an additional pivot hinge 680 of the type shown in FIGS. 40A–40D, and a second pivot hinge 682 of the type shown in FIGS. 41A–41D. Also, the pivot hinge 636 of FIGS. 39, 40, 45 and 46 is modified to include a third extension to fit within the support 616 of FIG. 48, as well as within the adjacent arms 604, 676. FIGS. 50A and 50B illustrate the respective positioning of the first pair of extensions 698 for the arms 604, 676, while the third extension of this modified pivot hinge is shown as 696 for the support 616. As with the collapsible patio chair construction of FIG. 46, side supports 664, 666 and 668 extend upwardly from the rear pad connectors of the cot to receive the posts 610, 612 and 672 of the canopy 691, in the telescoping, non-detachable manner alternatively described above.

Operation of the opening and closing of the canopy 691 will be appreciated to be identical to that with the reclining beach chair and patio chair, except that to collapse the canopy 691 and the sunshade, a forward pressure must be produced upon both the hinges 638 and 682 in the direction of the elbows 606, 608 and 670.

The configuration of FIGS. 48 and 49 include the modification of the design of the cot for the addition of the tubular supports 664, 666 and 668 to receive the posts 610, 612 and 672. In this respect, the rear connectors 452, 462 and 454 are likewise modified to receive the supports as they extend downwardly to the rear pad connectors 444, 446 and 448, and to hold them in position. The various connectors and pad connectors of FIGS. 48 and 49 could also be further modified to accept rivets or other fasteners to hold the supports secure. As will be appreciated,this simplifies the attachment of the canopy 600 with the collapsible cot, utilizing shorter posts without having to try to jiggle the three posts in position within the three rear pad connectors when attempting to attach the sunshade. To fold the cot, it will be seen that the sunshade first has to be collapsed, and the cot then collapsed as before. Such collapse of the sunshade is effected by flipping the canopy upward and back some 270° so that the supports 614, 616 and 674 essentially extend downwardly, parallel to the posts and supports 610 (664), 612 (668) and 672 (666), respectively.

In either construction of the sunshade of the invention—whether together with the reclining beach chair or lounger, or with the patio chair—pushing in on the pivot hinge 638 (or 638 with 682) beforehand, together with the described method of collapsing the lounger, or patio chair produces the end result of collapsing the lounger or chair to a compact package. As with the cot, the sunshade can either be removed and stowed separately, or collapsed where the posts are of the telescoping design.

While there have been described what are considered to be preferred embodiments of the present invention, it will be appreciated that modifications can be made without departing from the scope of the teachings herein. Thus, whereas the elbows of the sunshade frame have been described of generally a plastic composition of T-shape—and of a particular manner of locking the post to the support—other fabrications can be had in obtaining similar results. Thus, making the elbows of materials other than plastic, in shapes other than in a "T" configuration or with just a metal pin joining the support and post together might provide similar results. It will be appreciated by those skilled in the art that these, too, fall within the scope of the invention of having a sunshade which can collapse along with the lounger, patio chair and cot—all to a compact package for easy carrying and/or storage, and regardless of whether the thumb depress of the elbows face inwardly of the canopy (as 608 in FIG. 48) or whether they face outwardly therefrom (as 606 and 608 in FIG. 39, or as 606 and 670 in FIG. 48). And, as will also be appreciated, even for the preferred embodiment of the sunshade with the collapsible cot of FIG. 48, a modification could still be made, according to the invention, to incorporate only 3 pivot hinges 634, 636 and 680 (instead of the 5 with the pivot hinges 638 and 682) simply by eliminating the elbow 608 and the couplings to it, in which case the pivot hinge 636 could be of the 2-extension variety of FIG. 40, between adjacent arms, and operate as with the collapsible patio chair, collapsing inward when being folded. For at least such reasons, therefore, resort should be had to the claims appended hereto for a true understanding of the scope of the invention.

I claim:

1. A collapsible sunshade for casual seating, comprising:

a canopy including first and second arms, first and second elbows, first and second posts individually coupled to said first and second elbows respectively, first and second supports coupled to said first and second elbows with each support having a pair of ends and being at an angle with respect to individual ones of said posts when coupled to said elbows;

first and second pivot hinges individually coupled between adjacent facing ends of individual ones of said first and second arms and said first and second supports;

a third pivot hinge coupled to facing second ends of said first and second arms in orientation to fold one of said first and second arms towards said first and second elbows when pushed; and a fabric covering connected to said first and second supports adjacent to the pairs of opposite ends thereof; and wherein said third pivot hinge is coupled to facing second ends of said unfold said first and second arms away from said first and second elbows when pulled.

2. The collapsible sunshade of claim 1 wherein said third pivot hinge is coupled to rotate said first and second arms from substantially 180° when opened to substantially 0° when closed.

3. The collapsible sunshade of claim 2 wherein said first and second pivot hinges are coupled to rotate said first and second arms from substantially 90° when opened to substantially 0° when closed.

4. The collapsible sunshade of claim 1 wherein said first and second supports individually couple to said first and second elbows at an angle of substantially 90°.

5. The collapsible sunshade of claim 1 wherein said first and second supports individually couple to said first and second elbows at an angle of less than 90°.

6. The collapsible sunshade of claim 1 wherein each of said first and second elbows include a push pin to secure said first and second supports in position.

7. The collapsible sunshade of claim 1 wherein said push pin is spring biased in a direction towards one end of said first and second supports.

8. The collapsible sunshade of claim 1 wherein said first and second supports each include an aperture adjacent said one end of said supports to receive said push pin in securing said support in position.

9. The collapsible sunshade of claim 8 wherein said first and second elbows are T-shaped, each having a cross-piece secured to said one end of said support and a column secured to said post.

10. The collapsible sunshade of claim 1 wherein said first and second posts are of a length of substantially 3 feet.

* * * * *